US006367967B1

(12) United States Patent
Kojima et al.

(10) Patent No.: US 6,367,967 B1
(45) Date of Patent: Apr. 9, 2002

(54) TIME-MEASUREMENT DEVICE AND METHOD OF CONTROLLING THE SAME

(75) Inventors: Hiroyuki Kojima, Matsumoto; Makoto Okeya, Nagano-ken; Hiroshi Yabe, Shiojiri; Noriaki Shimura, Shiojiri; Joji Kitahara, Shiojiri, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/454,479

(22) Filed: Dec. 3, 1999

(30) Foreign Application Priority Data

Dec. 11, 1998 (JP) ..... 10-352894
Oct. 7, 1999 (JP) ..... 11-287382

(51) Int. Cl.[7] ..... G04B 47/00

(52) U.S. Cl. ..... 368/185; 368/10; 368/74; 368/80

(58) Field of Search ..... 368/10, 72–74, 368/80, 11, 110, 157, 160, 184, 185

(56) References Cited

U.S. PATENT DOCUMENTS 5,113,381 A * 5/1992 Sakamoto et al. ..... 368/74
5,245,591 A * 9/1993 Katou ..... 368/80
5,297,118 A * 3/1994 Sakumoto ..... 368/10
5,335,211 A * 8/1994 Muto et al. ..... 368/11
5,386,399 A * 1/1995 Masaki ..... 368/110

FOREIGN PATENT DOCUMENTS

| | | |
|---|---|---|
| JP | 58-176570 | 10/1983 |
| JP | 60-147680 | 8/1985 |
| JP | 61-202186 | 9/1986 |
| JP | 3-7833 | 2/1991 |

* cited by examiner

*Primary Examiner*—Bernard Roskoski
(74) *Attorney, Agent, or Firm*—Mark P. Watson

(57) ABSTRACT

To reduce electric power consumed during the operation of adjusting the indication of time and reduce the time required for the time adjusting operation. Using a second hand driving motor and a hour/minute hand driving motor both capable of rotating in both clockwise and counterclockwise directions, the indication of time is adjusted by driving the second hand driving motor and the hour/minute hand driving motor at times different from each other. The hand driving method (hand driving direction) is determined on the basis of the time elapsed during the power saving mode measured by a time information adjusting part such that the hands are driven in a direction which results in a reduction in the power consumption or the adjusting time.

50 Claims, 9 Drawing Sheets

TIME-MEASUREMENT DEVICE AND METHOD OF CONTROLLING THE SAME

BACKGROUND OF THE INVENTION

1. Field of the Invention

The present invention relates to a time-measurement device having the capability of indicating time and also to a method of controlling such a time-measurement device.

2. Description of the Related Art

The present invention relates to a time-measurement device and a method of controlling the same. More specifically, the present invention relates to a time-measurement device having the capability of automatically switching the operating mode from a power saving mode to a normal mode and also to a method of controlling such a time-measurement device. A time-measurement device is known which includes an electric power generator, a power supply, and an electric power consuming part wherein electric power generated by the electric power generator is stored in the power supply and the electric power stored in the power supply is consumed by the electric power consuming part. Some time-measurement devices of this type have, in addition to a normal driving mode in which electric power is consumed, a power saving mode in which the electric power consumed by the electric power consuming part is saved, wherein the operating mode is switched to the power saving mode depending on the condition in which a user uses the time-measurement device.

A specific example of the application of the mode switching capability described above is a wristwatch which operates in a normal time indication mode (normal mode, normal driving mode) when the wristwatch is being carried by a user and also during a predetermined period of time after the end of the carrying state. If the predetermined period of time has elapsed after the end of the carrying state, the operating mode automatically switches to the power saving mode in which indication functions are partially stopped so as to save the stored electric power. This wristwatches returns to the normal time indication mode (normal mode) in which the current time is indicated by hands from the power saving mode in which the driving of the hands is stopped, in a manner as described below.

When the operating mode is returned from the power saving mode in which the movement of the hands (hour, minute, and second hands) is stopped to the normal time indication mode in which the current time is indicated by the hands, a single motor is generally rotated at a higher speed than a normal speed at which the hands are driven in the normal mode so that all hands are driven quickly to adjust the indication of time to the current time. In this technique, the hour, minute, and second hands are driven quickly by amounts by which the hands would have been driven during the period of time elapsed in the power saving mode if the operating mode were in the normal time indication mode.

In the conventional portable wristwatch described above, when all hands are quickly driven at the same time, a greater amount of electric power is consumed than required in the normal operating mode. In the case of a wristwatch using a battery to drive the hands, the increase in the power consumption can cause the power supply voltage to become unstable and thus can cause the adjusting of the indication of time to fail. Another problem is that because all hands are driven by the single motor, a large electric power is required to drive the motor itself, and a long time is required to adjust the indication of time.

A technique of solving the above problems is to drive the hands using a plurality of motors. However, if the plurality of motors are driven at the same time, the power consumption increases. Furthermore, the increase in the power consumption can cause the power supply voltage to become unstable and thus can cause the adjusting of the indication of time to fail. Furthermore, in the case where the hands are moved by small amounts in the operation of adjusting the indication of time, it is difficult for a user to visually recognize whether or not the indication of time has been correctly adjusted.

OBJECTS OF THE INVENTION

Therefore, it is an object of the present invention to overcome the aforementioned problems.

In view of the above, it is an object of the present invention to provide a time-measurement device which consumes less electric power in the operation of adjusting the indication of time which allows a user to easily recognize whether or not adjusting of indication of time has been correctly performed. It is another object of the present invention to provided a method of controlling such a time-measurement device.

SUMMARY OF THE INVENTION

In accordance with a first aspect of the present invention, there is provided a time-measurement device comprising: a power supply or power supply means for supplying electric power; a time indicator or time indicating means including a plurality of indication hand driving parts for driving corresponding indication hands using electric power supplied by the power supply means so as to indicate time by the plurality of indication hands; a controller or control means for switching the operating mode for each of the indication hand driving parts in accordance with a predetermined condition, between a power saving mode in which the corresponding indication hand is not driven and a normal indication mode in which the corresponding indication hand is continuously driven; an elapsed-time memory or storage means for storing the time elapsed in the power saving mode; and a time adjuster or adjusting means for adjusting indication of time by driving the indication hands using the indication hand driving parts in accordance with the time elapsed in the power saving mode when the operating mode is switched from the power saving mode to the normal indication mode; wherein the time adjusting means includes a time adjusting operation controller or control means for controlling the timing of driving the indication hand driving parts in the operation of adjusting the indication of time such that the plurality of indication hand driving parts are driven in a predetermined order and such that an overlap among adjusting operation periods of the plurality of indication hand driving parts is less than a predetermined value.

In accordance with a second aspect of the present invention, there is provided a time-measurement device wherein the time adjusting operation control means sets the adjusting operation periods for the plurality of indication hand driving parts such that there is no overlap among the operation periods.

In accordance with a third aspect of the present invention, there is provided a time-measurement device wherein the time adjusting means adjusts the indication of time such that, of the plurality of indication hand driving parts, an indication hand driving part having a lower normal driving speed is driven for adjustment before an indication hand driving part having a higher normal driving speed is driven for adjustment.

In accordance with a fourth aspect of the present invention, there is provided a time-measurement device wherein the time adjusting means adjusts the indication of time such that, of the plurality of indication hand driving parts, an indication hand driving part having a higher normal driving speed is driven for adjustment before an indication hand driving part having a lower normal driving speed is driven for adjustment.

In accordance with a fifth aspect of the present invention, there is provided a time-measurement device wherein the time adjusting means adjusts the indication of time such that the hour/minute hand driving means is driven preceding the second hand driving means, and the second hand driving means is driven after completion of the driving of the hour and minute hands.

In accordance with a sixth aspect of the present invention, there is provided a time-measurement device wherein when the time adjusting means adjusts the indication of time, the time adjusting means drives the plurality of hand driving parts by outputting driving pulses to the plurality of hand driving parts such that there is no overlapping in the timing of outputting the driving pulses.

In accordance with a seventh aspect of the present invention, there is provided a time-measurement device wherein when the time adjusting means adjusts the indication of time, a time adjusting driver or means drives a hour hand driver or driving means, a minute hand driver or driving means, and second hand driver or driving means in an exclusive fashion in the following order:

hour hand driving means→minute hand driving means→second hand driving means.

In accordance with a eighth aspect of the present invention, there is provided a time-measurement device comprising: power supply means for supplying electric power; time indicating means including indication hand driving means for driving an indication hand using electric power supplied by the power supply means so as to indicate time by the indication hand; control means for switching the operating mode in accordance with a predetermined condition, between a power saving mode in which the corresponding indication hand is not driven and a normal indication mode in which the corresponding indication hand is continuously driven; elapsed-time storage means for storing the time elapsed in the power saving mode; and time adjusting means for adjusting indication of time by driving the indication hands using the indication hand driving means in accordance with the time elapsed in the power saving mode when the operating mode is switched from the power saving mode to the normal indication mode; wherein the time adjusting means includes a time adjusting direction determination circuit or means for determining the direction in which the indication hand is driven to adjust the indication of time, in accordance with the time elapsed in the power saving mode.

In accordance with a ninth aspect of the present invention, there is provided a time-measurement device wherein the time adjusting direction determination means selects a direction, as the time adjusting direction, in which the indication hand is driven with less electric power than would be required to drive the indication hand in the opposite direction.

In accordance with a tenth aspect of the present invention, there is provided a time-measurement device wherein the time adjusting direction determination means selects a direction, as the time adjusting direction, in which the indication hand is driven in a shorter time than would be required to drive the indication hand in the opposite direction.

In accordance with a eleventh aspect of the present invention, there is provided a time-measurement device wherein when the angle R [°] required to rotate to adjust the indication of time is less than a predetermined value RT [0], the time adjusting means determines the time adjusting rotation angle $R_{RET}$ in accordance with the following equation:

$$R_{RET}=R+360\times n[°]\text{(where n is a natural number).}$$

In accordance with a twelfth aspect of the present invention, there is provided a time-measurement device wherein when indication of time is adjusted, the time adjusting means maintains the second hand at the position where the second hand has been at rest during the power saving mode until the time indicated by the second hand at rest becomes coincident with the actual current time and starts to drive the second hand when the time indicated by the second hand at rest has become coincident with the actual current time.

In accordance with a thirteenth aspect of the present invention, there is provided a time-measurement device wherein when the angle R [°] required to rotate to adjust the indication of time is less than a predetermined value RT [20] and when an additional rotation angle is set to $\alpha$, the time adjusting means determines the time adjusting rotation angle $R_{RET}$ in accordance with the following equation:

$$R_{RET}=R+\alpha[\mathbf{20}],$$

and drives an associated hand in a first direction by the angle determined, and then drives the hand by the rotation angle $\alpha$ in a second direction opposite to the first direction.

In accordance with a fourteenth aspect of the present invention, there is provided a time-measurement device wherein when the angle between the hand position corresponding to the current time and the actual hand position is greater than a predetermined value, the time adjusting direction determination means selects the direction in which the hand is driven to adjust the hand position such that the indication hand is driven in a direction opposite to the direction in which the hand is driven in the normal mode.

In accordance with a fifteenth aspect of the present invention, there is provided a time-measurement device wherein the time-measurement device includes a plurality of indication hand drivers or driving means for driving different indication hands; and the time adjusting direction determination means determines the adjusting direction for each of the plurality of indication hand driving means.

In accordance with a sixteenth aspect of the present invention, there is provided a time-measurement device wherein the time adjusting means adjusts the indication of time such that, of the plurality of indication hand driving parts, an indication hand driving part having a lower normal driving speed is driven for adjustment before an indication hand driving part having a higher normal driving speed is driven for adjustment.

In accordance with a seventeenth aspect of the present invention, there is provided a time-measurement device wherein the indication hand driving means includes an hour/minute hand driver or driving means for driving a hour hand and a minute hand, and a second hand driver or driving means for driving a second hand; wherein the time adjusting direction determination means determines the direction in which a hand is driven to adjust the indication of time for each of the hour/minute hand driving means and the second hand driving means.

In accordance with a eighteenth aspect of the present invention, there is provided a time-measurement device wherein the indication hand driving means includes an hour hand driver or driving means for driving a hour hand, a minute hand driver or driving means for driving a minute hand, and a second hand driver or driving means for driving a second hand; and the time adjusting direction determination means determines the direction in which a hand is driven to adjust the indication of time for each of the hour hand driving means, the minute hand driving means, and the second hand driving means.

In accordance with a nineteenth aspect of the present invention, there is provided a time-measurement device wherein the power supply means includes an electric power store or storage means for storing electric energy.

In accordance with a twentieth aspect of the present invention, there is provided a time-measurement device wherein the power supply means includes an electric power generator or generation means for generating electric power by converting first energy to second energy in the form of electric energy, and an electric power store or storage means for storing the generated electric energy.

In accordance with a twenty-first aspect of the present invention, there is provided a time-measurement device wherein the first energy is energy selected from the group consisting of kinetic energy, light energy, thermal energy, pressure energy, and electromagnetic wave energy.

In accordance with a twenty-second aspect of the present invention, there is provided a time-measurement device wherein the power supply means is a primary battery.

In accordance with a twenty-third aspect of the present invention, there is provided a time-measurement device wherein the condition is the state in which electric power is generated by the electric power generation means or the state in which electric energy is stored in the power supply means.

In accordance with a twenty-fourth aspect of the present invention, there is provided a time-measurement device further comprising a carrying state detector or detection means for detecting whether or not the time-measurement device is being carried, wherein the condition is the state in which the time-measurement device is being carried.

In accordance with a twenty-fifth aspect of the present invention, there is provided a method of controlling a time-measurement device comprising: a power supply device for supplying electric power; a time indication device including a plurality of indication hand driving parts for driving corresponding indication hands using electric power supplied by the power supply device so as to indicate time by the plurality of indication hands; a controller for switching the operating mode for each of the indication hand driving parts in accordance with a predetermined condition, between a power saving mode in which the corresponding indication hand is not driven and a normal indication mode in which the corresponding indication hand is continuously driven; and an elapsed-time memory for storing the time elapsed in the power saving mode; the method comprising a time adjusting step for adjusting indication of time by driving the indication hands using the indication hand driving parts in accordance with the time elapsed in the power saving mode when the operating mode is switched from the power saving mode to the normal indication mode, wherein the time adjusting step includes a time adjusting operation control step for controlling the plurality of indication hand driving parts in the operation of adjusting the indication of time such that the plurality of indication hand driving parts are driven in a predetermined order and such that an overlap among adjusting operation periods of the plurality of indication hand driving parts is less than a predetermined value.

In accordance with a twenty-sixth aspect of the present invention, there is provided a method of controlling a time-measurement device comprising: a power supply device for supplying electric power; a time indication device including an indication hand driving device for driving an indication hand using electric power supplied by the power supply device so as to indicate time by the indication hand; a controller for switching the operating mode in accordance with a predetermined condition, between a power saving mode in which the corresponding indication hand is not driven and a normal indication mode in which the corresponding indication hand is continuously driven; and an elapsed-time memory for storing the time elapsed in the power saving mode; the method comprising a time adjusting step for adjusting indication of time by driving the indication hand using the indication hand driving device in accordance with the time elapsed in the power saving mode when the operating mode is switched from the power saving mode to the normal indication mode, wherein the time adjusting step includes an adjusting direction determination step for determining the direction in which the indication hand is driven to adjust the indication of time, in accordance with the time elapsed in the power saving mode.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

DESCRIPTION OF THE PREFERRED EMBODIMENTS

Preferred embodiments of the present invention are described below.

[1] General Construction of an Embodiment of a Time-measurement Device

Figure 1:
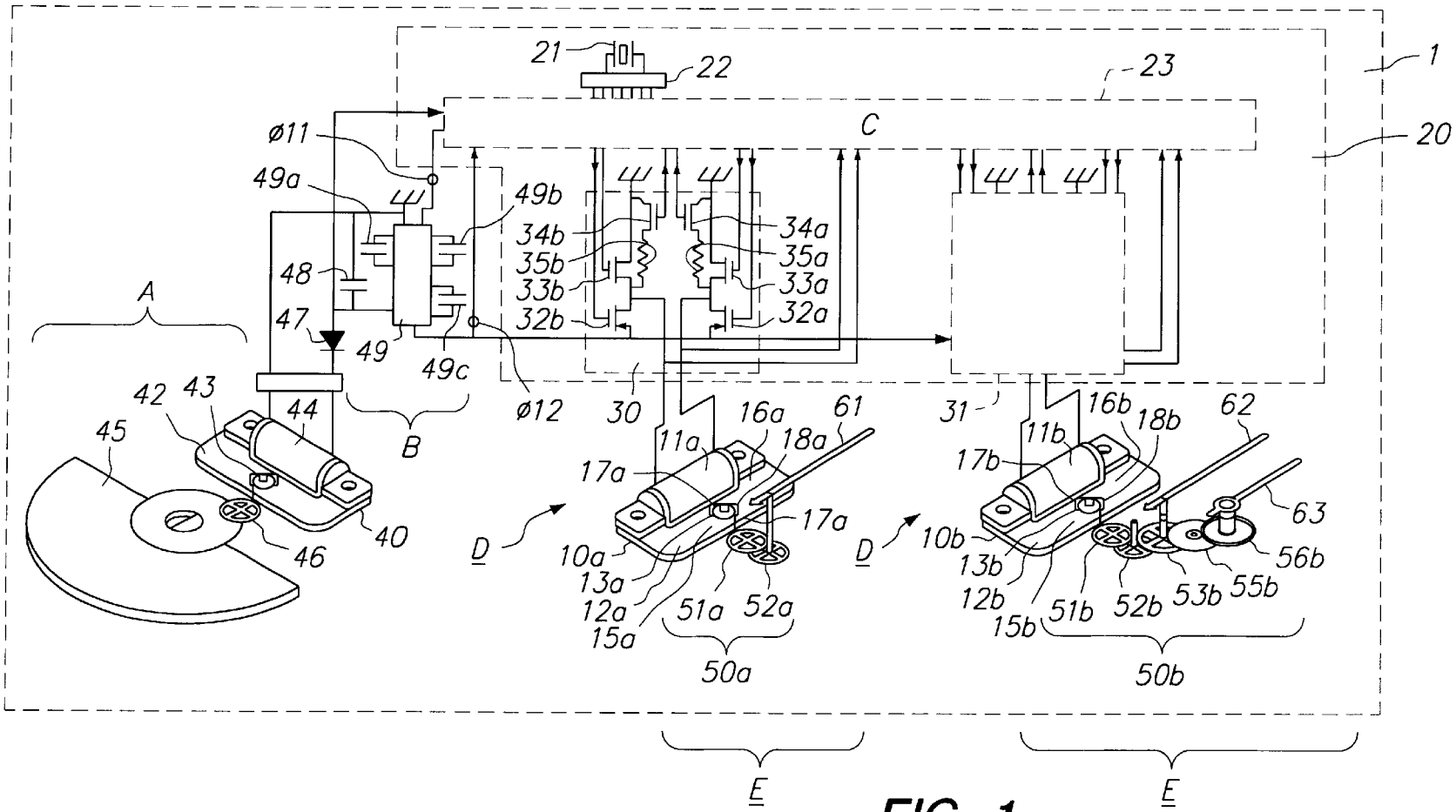
FIG. 1 is a schematic diagram illustrating the construction of a time-measurement device 1 according to a first embodiment of the present invention.

FIG. 1 illustrates the general construction of an embodiment of a time-measurement device.

Herein, the time-measurement device 1 is of the wristwatch type, which is used by a user in such a manner that a belt connected to the main body of the wristwatch is wound around a wrist of the user.

The time-measurement device 1 comprises mainly: an electric power generating part A for generating electric power in an AC form; a power supply B for rectifying an AC voltage generated by the electric power generating part A, stepping-up the rectified voltage, storing the stepped-up voltage, and supplying electric power to various component parts; a controller C including an electric power generation state detector 91 (refer to FIG. 2) for detecting the state in which electric power is generated by the electric power generating part A and serving to control the time-measurement device 1 over the entire part thereof in accordance with the detection result given by the electric power generation state detector 91; a driver D for driving a hand driving mechanism E in accordance with a control signal supplied by the controller C; and the hand driving mechanism E serving as a time indicator or time indicating means for moving respective hands and indicating time thereby.

The driver D includes indication hand driving means including a plurality of sub indication hand drivers or driving means, that is, a second hand driving motor 10*a*, a hour/minute hand driving motor 10*b*, a driver 30 for driving the second hand driving motor 10*a*, and a driver 31 for driving the hour/minute hand driving motor 10*b*. The hand driving mechanism E serving as the time indicator or indicating means includes wheel trains 50*a* and 50*b* for transmitting the driving force from the respective motors to the corresponding indication hands, and a second hand 61, a minute hand 62, and a hour hand 63, which are driven by the transmitted driving force.

The controller C switches the operating mode depending on the state in which electric power is generated by the electric power generating part A, between the normal indication mode in which time is indicated by driving the hand driving mechanism E and the power saving mode in which power supply to the hand driving mechanism E is stopped so as to save the electric power. The switching from the power saving mode to the normal indication mode is performed when a user swing the time-measurement device 1 with his/her hand to intentionally generate electric power.

The respective component parts are described in further detail below. The controller C will be described later with reference to a functional block diagram.

[1.1] Electric Power Generating Part

The electric power generating part A includes an electric power generator 40, a rotatable weight 45, and a step-up gear 46. The electric power generator 40 is constructed in the form of an electromagnetic induction type AC generator including a rotor 43 which rotates in a stator 42. The rotation of the rotor 43 generates electric power in a coil 44 connected to the stator 42. The generated electric power is externally output. The rotatable weight 45 serves as means for transmitting kinetic energy to the rotor 43 of the electric power generator. The motion of the rotatable weight 45 is transmitted to the rotor 43 of the electric power generator via the step-up gear 46. In response to motion of the arm of the user, the rotatable weight 45 rotates in the time-measurement device 1. That is, electric power is generated using energy supplied via motion of the user in everyday life thereby driving the time-measurement device 1.

[1.2] Power Supply

The power supply B includes a diode 47 serving as a rectifying circuit, a large-capacitance capacitor 48, and a step-up/down circuit 49. A limiter LM (refer to FIG. 2), the rectifier (diode) 47, and large-capacitance capacitor 48 may be disposed in this order starting from the side of the electric power generating part A as shown in FIG. 1 or they may also be disposed in the order the rectifier (diode) 47, the limiter LM, and the large-capacitance capacitor 48. The limiter circuit LM is provided for preventing an overvoltage from being applied to downstream circuits The step-up/down circuit 49 is capable of stepping up or down the given voltage using a plurality of capacitors 49*a*, 49*b*, and 49*c* in a multiple stage fashion. In response to a control signal ϕ11 supplied from the controller C, the step-up/down circuit 49 adjusts the voltage supplied to the driver E. The output voltage of the step-up/down circuit 49 is also supplied as a monitor signal ϕ12 to the controller C so that the output voltage can be monitored and so that the controller 20 determines, from a small change in the output voltage, whether or not electric power is generated by the electric power generating part A. The power supply part B employs Vdd (high-level voltage) as a reference voltage level (GND) and generates Vss (low-level voltage) as a power supply voltage.

[1.3] Hand Driving Mechanism

The hand driving mechanism E serving as the time indicating means is described below.

In the hand driving mechanism E, stepping motors are used as the second hand driving motor 10*a* and the hour/minute hand driving motor 10*b*. The stepping motor is also called a pulse motor, a stepper motor, or a digital motor, and is widely used as an actuator in digital controlling apparatus wherein the stepping motor is driven by a pulse signal. In recent years, various electronic devices have been developed which have a small size suitable for a user to carry. In such electronic devices, a small-sized light-weight stepping motor is widely used as an actuator. A representative example of such an electronic device is a time-measurement device such as an electronic time-measurement, a timer switch, chronograph, etc.

The second hand driving motor 10*a* includes a driving coil 11*a* which generates a magnetic force when a driving pulse is supplied from the driver 30 to the driving coil 11, a stator 12*a* excited by the driving coil 11*a*, and a rotor 13*a* which is located in a space surrounded by the stator 12*a* and which is rotated by a magnetic field generated by the stator 12*a*. The second hand driving motor 10*a* is constructed in the form of a PM (rotating permanent magnet) type in which the rotor 13*a* is formed of a disk-shaped two-pole permanent magnet. In the stator 12*a*, a magnetic saturation part 17*a* is formed such that a magnetic force generated by the driving coil 11*a* creates opposite magnetic phases (poles) at proper locations 15*a* and 16*a* on the perimeter around the rotor 13*a*. Furthermore, the stator 12*a* also includes an inner notch 18*a* formed at a proper location on the inner wall of the stator 12*a* such that a cogging torque produced by the presence of the inner notch 18*a* causes the rotor 13*a* to come to rest in a proper position which determines the direction of rotation of the rotor 13*a*.

The rotation of the rotor 13*a* of the stepping motor 10*a* is transmitted to the respective hands via the wheel train 50*a* which consists of a fifth wheel 51*a* and a fourth wheel 52*a* and which meshes with the rotor 13*a* via a pinion. A second hand 61 is connected to the shaft of the fourth wheel 52*a*. Time is indicated by these hands in response to the rotation of the rotor 13*a*. The wheel train 50*a* may also be connected to a transmission system (not shown) for indicating the year, month, and day.

The hour/minute hand driving motor 10*b* includes a driving coil 11*b* which generates a magnetic force when a driving pulse is supplied from the driver 31 to the driving coil 11*b*, a stator 12*b* excited by the driving coil 11*b*, and a rotor 13*b* which is located in a space surrounded by the stator 12*b* and which is rotated by a magnetic field generated by the stator 12*b*. The hour/minute hand driving motor 10*b* is constructed in the form of a PM (rotating permanent magnet) type in which the rotor 13*b* is formed of a disk-shaped two-pole permanent magnet. In the stator 12*b*, a magnetic saturation part 17*b* is formed such that a magnetic force generated by the driving coil 11*b* creates opposite magnetic phases (poles) at proper locations 15*b* and 16*b* on the perimeter around the rotor 13*b*. Furthermore, the stator 12*b* also includes an inner notch 18*b* formed at a proper location on the inner wall of the stator 12*b* such that a cogging torque produced by the presence of the inner notch 18*b* causes the rotor 13*b* to come to rest in a proper position which determines the direction of rotation of the rotor 13*b*.

The rotation of the rotor 13*b* of the hour/minute hand driving motor 10*b* is transmitted to the respective hands via the wheel train 50*b* which consists of a fifth wheel 51*b*, a fourth wheel 52*b*, a third wheel 53*b*, a second wheel 54*b*, a minute wheel 55*b*, and hour wheel 56*b* and which meshes with the rotor 13*b* via a pinion. The second wheel 54*b* is connected to the minute hand 62, and the hour wheel 56*b* is connected to the hour hand 63. Time is indicated by these hands in response to the rotation of the rotor 13*b*. The wheel train 50*b* may also be connected to a transmission system (not shown) for indicating the year, month, and day.

Under the control of the controller C, the driver 30 and the driver 31 supply various driving pulses to the second hand driving motor 10*a* and the hour/minute hand driving motor 10*b*, respectively. The driver 30 includes a bridge circuit formed of a p-channel MOSFET 33*a*, an n-channel MOSFET 32*a*, a p-channel MOSFET 33*b*, and an n-channel MOSFET 32*b* wherein the p-channel MOSFET 33*a* and the n-channel MOSFET 32*a* are connected in series and the p-channel MOSFET 33*b* and the n-channel MOSFET 32*b* are connected in series. The driver E includes rotation detecting resistors 35*a* and 35*b* connected in parallel to the p-channel MOSFETs 33*a* and 33*b*, respectively, and also includes sampling p-channel MOSFETs 34*a* and 34*b* for supplying chopper pulses to the resistors 35*a* and 35*b*, respectively. The controller C supplies various control pulses with different pulse widths at proper times to the gate electrodes of the respective MOSFETs 32*a*, 32*b*, 33*a*, 33*b*, 34*a*, and 34*b* thereby supplying driving pulses with a varying polarity to the driving coil 11*a* or supplying a detection pulse for excitation of a voltage used to detect the rotation of the rotor 13*a* or detect the magnetic field.

The driver 31 is constructed in a similar manner as the driver 30.

[1-2] Controller

Figure 2:
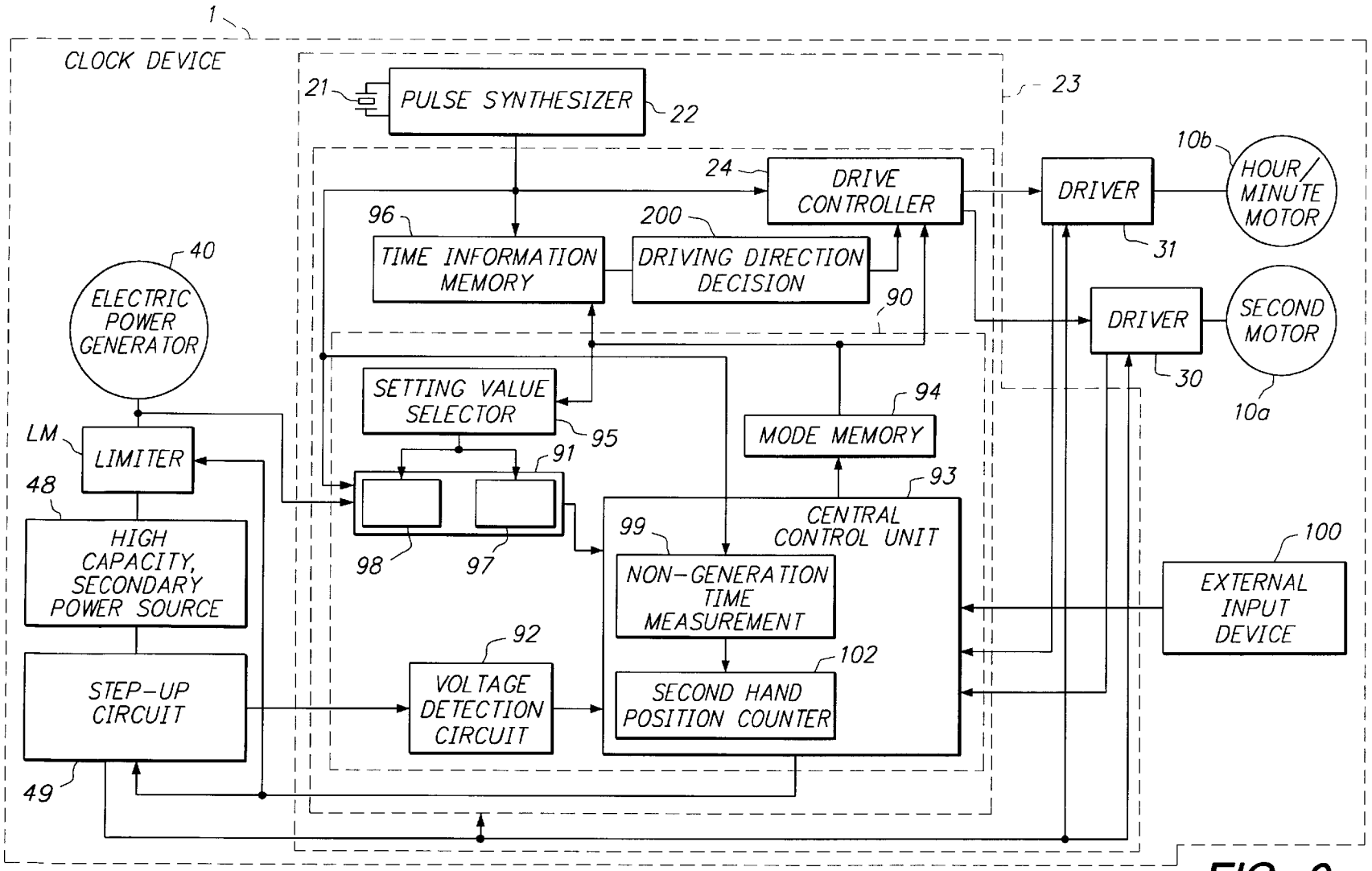
FIG. 2 is a functional block diagram illustrating a controller C of the first embodiment and associated parts.

The construction of the controller C is described below with reference to FIG. 2. FIG. 2 is a functional block diagram illustrating the controller C and associated peripheral parts. The controller C includes a pulse synthesizer 22, a mode setting unit 90, a time information memory 96, and a driving control circuit 24.

The pulse synthesizer 22 includes an oscillation circuit for generating a reference pulse at a stable frequency using a reference oscillator such as a quartz oscillator and also includes a mixing circuit for mixing the reference pulse and a pulse obtained from the reference pulse by means of frequency division so as to generate a pulse signal with a different pulse width and with different timing.

The mode setting unit 90 includes an electric power generation state detector 91, a set value selector 95 for switching a setting value used to detect the electric power generation state, a voltage detection circuit 92 for detecting the charge voltage Vc across the large-capacitance capacitor 48, a central control circuit 93 for controlling the operating mode depending on the electric power generation state and also controlling the step-up ratio depending on the charge voltage, and a mode memory 94 for storing the operating modes.

Herein the operating modes include at least the normal indication mode and the power saving mode. The normal indication mode is an operating mode in which time is indicated in a normal fashion by moving the second, minute, and hour hands by driving the second hand driving motor 10*a* and the hour/minute hand driving motor 10*b*. In the power saving mode, on the other hand, the electric power is saved by entirely stopping the normal rotation of the second hand driving motor 10*a* and hour/minute hand driving motor 10*b* used to move the hands. However, in the power saving mode, the oscillation circuit used to measure the time elapsed in the power saving mode and the counter controller are still operated so that the operating mode is switched to the normal indication mode when a predetermined condition such as an oscillation duration is met.

The electric power generation state detector 91 includes a first detection circuit 97 which compares the voltage Vgen generated by the electric power generator 40 with a predetermined voltage Vo thereby determining whether or not electric power is being generated, and a second detection circuit 98 which compares an electric power generation time Tgen during which the voltage Vgen generated by the electric power generator 40 is greater than a voltage Vbas set to a value significantly smaller than the predetermined value Vo. If either the first detection circuit 97 or the second detection circuit 98 detects a voltage greater than the comparison value, it is determined that electric power is being generated. Herein, the voltages Vo and Vbas have a negative value with respect to Vdd (=GND), that is, Vo and Vbas represents voltage differences from Vdd.

Figure 3:
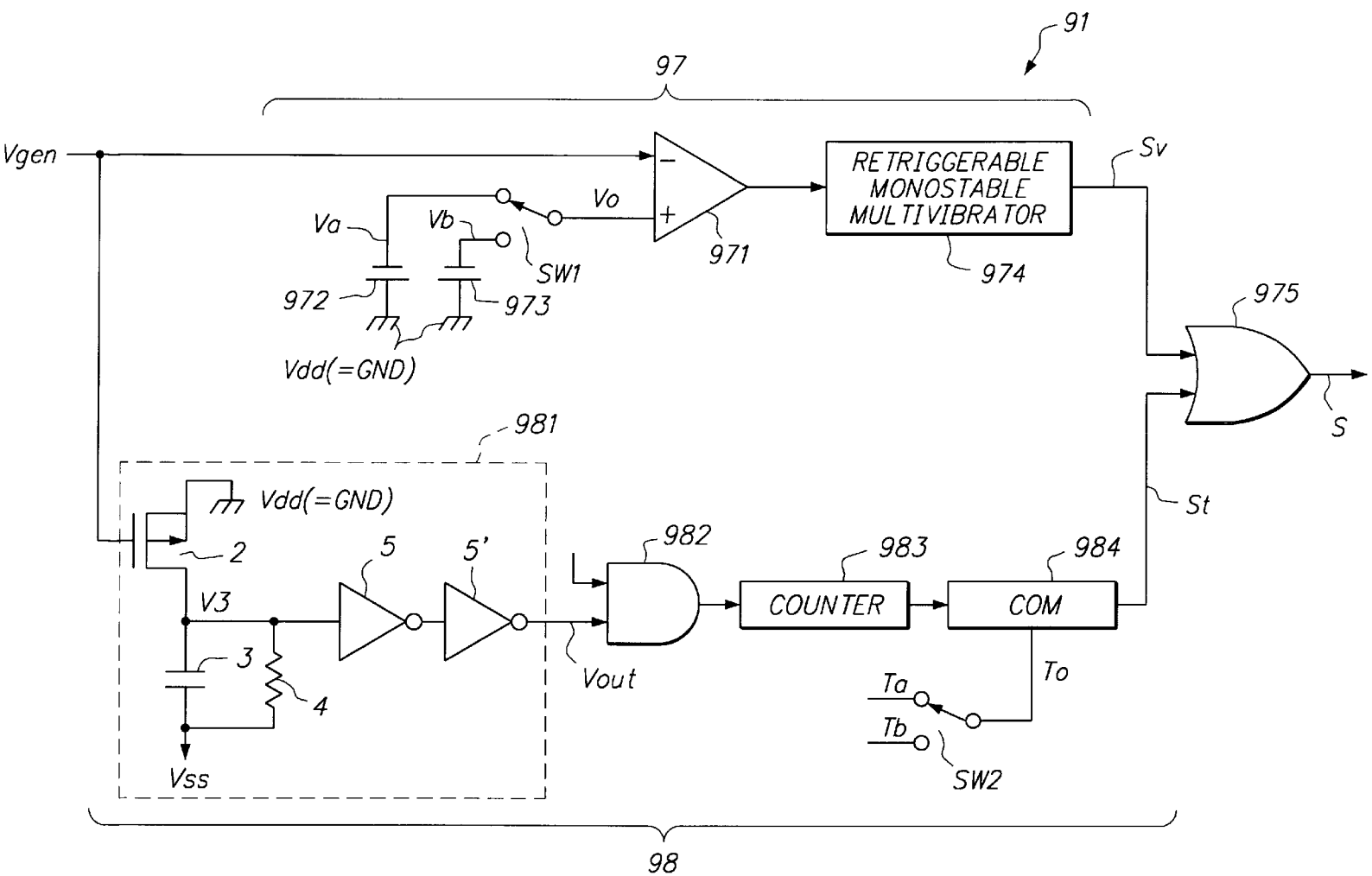
FIG. 3 is a circuit diagram of a first detection circuit and a second detection circuit according to the first embodiment.

Referring to FIG. 3, the constructions of the first detection circuit 97 and the second detection circuit 98 are described below.

As shown in FIG. 3, the first detection circuit 97 comprises mainly a comparator 971, a reference voltage source 972 for generating a constant voltage Va, a reference voltage source 973 for generating a constant voltage Vb, a switch SW1, and a retriggerable monostable multivibrator 974.

The voltage generated by the reference voltage source 972 is set to a value Va used in the normal indication mode and the voltage generated by the reference voltage source 973 is set to a value Vb used in the power saving mode. The reference voltage sources 972 and 973 are connected to a positive input terminal of the comparator 971 via the switch SW1. The switch SW1 is controlled by the set value selector 95 such that the reference voltage source 972 is connected to the positive input terminal of the comparator 971 in the normal indication mode while the reference voltage source 973 is connected to the positive input terminal of the comparator 971 in the power saving mode. The voltage Vgen generated by the electric power generating part A is connected to a negative input terminal of the comparator 971. Therefore, the comparator 971 compares the generated voltage Vgen with the set voltage Va or the set voltage Vb, and if the generated voltage Vgen is lower than the set voltage Va or the set voltage Vb, the comparator 971 outputs a high-level comparison result signal. If the generated voltage Vgen is higher than the set voltage Va or the set voltage Vb, the comparator 971 outputs a low-level comparison result signal.

When the retriggerable monostable multivibrator 974 is triggered by a rising edge of a low-to-high transition of the comparison result signal, the output of the retriggerable monostable multivibrator 974 rises from a low level to a high level and falls from the high level to the low level after a predetermined period of time. If the retriggerable monostable multivibrator 974 is again triggered before the expiration of the predetermined period of time, the retriggerable monostable multivibrator 974 adjusts the measuring of time and restarts measuring time.

The operation of the first detection circuit 97 is described below.

If the time-measurement device is operating in the normal indication mode, the switch SW1 selects the reference voltage source 972 so that the voltage Va is supplied to the comparator 971. Thus, the comparator 971 compares the set voltage Va with the generated voltage Vgen and generates a comparison result signal. In this case, in response to the rising edge of the comparison result signal, the output of the retriggerable monostable multivibrator 974 rises to the high level from the low level.

On the other hand, when the time-measurement device is in the power saving mode, the switch SW1 selects the reference voltage source 973 so that the set voltage Vb is supplied to the comparator 971. In this specific example, the generated voltage Vgen is lower than the set voltage Vb, and thus no trigger signal is input to the retriggerable monostable multivibrator 974. Therefore, the voltage detection signal Sv is maintained at the low level.

As described above, the first detection circuit 97 compares the generated voltage Vgen with the set voltage Va or Vb selected depending on the operating mode and generates a voltage detection signal S indicating the comparison result.

On the other hand, as shown in FIG. 3, the second detection circuit 98 includes an integrating circuit 981, a gate 982, a counter 983, a digital comparator 984, and a switch SW2.

The integrating circuit 981 includes a MOS transistor 2, a capacitor 3, a pull-up resistor 4, an inverter 5, and an inverter 5'.

The generated voltage Vgen is connected to the gate of the MOS transistor 2 such that the MOS transistor 2 is turned on and off repeatedly by the generated voltage Vgen thereby controlling the operation of charging the capacitor 3. In the case where a switch or switching means is formed of MOS transistor 2, the integrating circuit 981 and the inverter 5 may be formed of a low-cost CMOS-IC. However, the switching device and the voltage detection means may also be formed of bipolar transistors. The pull-up resistor 4 fixes the voltage V3 of the capacitor 3 to Vss when no electric power is generated. The pull-up resistor 4 also serves as a path via which a leakage current flows when no electric power is generated. The pull-up resistor 4 has a resistance as large as several ten to several hundred MΩ. The pull-up resistor 4 may be formed of a MOS transistor having a large on-resistance. The voltage V3 of the capacitor 3 is judged by the inverter 5 connected to the capacitor 3. The output of the inverter 5 is inverted and output as a detection signal Vout. The threshold voltage of the inverter 5 is set to Vbas substantially smaller than the set voltage Vo used in the first detection circuit 97.

The reference signal from the pulse synthesizer 22 and the detection signal Vout are supplied to the gate 982. As a result, the counter 983 counts the number of reference signals during a period in which the detection signal Vout is at the high level. The counted value is supplied to one input of the digital comparator 983. The other input of the digital comparator 983 is supplied with a set time value To corresponding to the set time period. If the time-measurement device is operating in the normal indication mode, a set time value Ta is supplied to the digital comparator 983 via the switch SW2, while a set time value Tb is supplied via the switch SW2 when the time-measurement device is in the power saving mode, wherein the switch SW2 is controlled by the setting value selector 95.

The digital comparator 984 outputs the comparison result as an electric power generation time detection signal St in synchronization with the falling edge of the detection signal Vout. If the electric power generation time exceeds the set time value, the electric power generation time detection signal St becomes high, while it is at the low level when the electric power generation time is shorter than the set time value.

The second detection circuit 98 operates as follows. When the electric power generating part A starts to generate AC power, the electric power generator 40 generates a voltage Vgen via the diode 47.

If the voltage Vgen falls down to Vss from Vdd as a result of the start of generation of electric power, the MOS transistor 2 turns on and the charging of the capacitor 3 starts. The voltage V3 is fixed to Vss via the pull-up resistor 4 when no electric power is generated. However, if electric power is generated and the charging of the capacitor 3 starts, the voltage V3 starts to rise toward Vdd. When the generated voltage Vgen starts to increase toward Vss and thus the MOS transistor 2 turns off, the charging of the capacitor 3 stops. However, the voltage V3 is maintained by the capacitor 3. The above operation is performed repeatedly as long as electric power is generated, and thus the voltage V3 increases until it becomes equal to Vdd. If the voltage V3 exceeds the threshold voltage of the inverter 5, the detection signal Vout output from the inverter 5' rises to a high level from a low level, and thus the generation of electric power is detected. The response time required to detect the generation of electric power may be set to an arbitrary value by adjusting the charging current used to charge the capacitor 3 by connecting a current limiting resistor or by varying the capacity of the MOS transistor, or otherwise by adjusting the capacitance of the capacitor 3.

If the generation of electric power stops, the voltage Vgen becomes constant at Vdd, and thus the MOS transistor 2 is maintained in the off-state. Although the voltage V3 is maintained by the capacitor 3 for a certain period of time, a very small leakage current through the pull-up resistance 4 causes the charge on the capacitor 3 to decrease, and thus the voltage V3 gradually decreases from Vdd toward Vss. When the voltage V3 becomes lower than the threshold voltage of the inverter 5, the detection signal Vout output from the inverter 5' changes to the low level from the high level, and thus it is detected that no electric power is generated. The response time in terms of the detection of non-generation of electric power may be set to an arbitrary value by varying the resistance of the pull-up resistor 4 thereby adjusting the leakage current of the capacitor 3.

The detection signal 5 is gated by the gate 982 in response to the reference signal and counted by the counter 983. The digital comparator 984 compares the count value with a value corresponding to the set time at time T1. If the high-level duration Tx of the detection signal Vout is longer than the set time value To, the electric power generation time detection signal St changes from the low level to the high level.

The dependence of the generated voltage Vgen upon the rotation speed of the rotor 43 of the electric power generator and the dependence of the detection signal Vout upon the generated voltage Vgen are described below.

The voltage level and the period (frequency) of the generated voltage Vgen varies depending on the rotation speed of the rotor 43 of the electric power generator. More specifically, with the rotation speed, the amplitude of the generated voltage Vgen increases and the period decreases. That is, the output duration (electric power generation time) of the detection signal Vout varies depending on the rotation speed of the rotor 43 of the electric power generator and thus depending on the strength of the electric power generated by the electric power generator 40. When the rotation speed of the rotor 43 is low, that is, when the generated electric power is weak, the output duration of the detection signal Vout becomes equal to ta. On the other hand, when the rotation speed of the rotor 43 is high, that is, when the generated electric power is strong, the output duration of the detection signal Vout becomes equal to tb. Herein, ta<tb. Thus, the strength of the electric power generated by the electric power generator 40 can be detected from the length of the output duration of the detection signal Vout.

Herein, the set voltage Vo and the set time value To can be switched by the set value selector 95. More specifically, when the operating mode is switched from the normal indication mode to the power saving mode, the setting value selector 95 changes the values of the set values Vo and To for the first and second detection circuits 97 and 98 of the electric power generation detecting circuit 91. In the present embodiment, Va and Ta in the normal indication mode are set to values smaller than the corresponding values Vb and Tb employed in the power saving mode. Therefore, greater electric power has to be generated to switch the operating mode from the power saving mode to the normal indication mode. The magnitude of the electric power required to switch the operating mode from the power saving mode to the normal indication mode should be greater than magnitudes usually obtained when the time-measurement device 1 is carried and should be as large as that which is obtained when a user swing his/her arm with the intention of generating electric power for charging. In other words, Vb and Tb in the power saving mode are set to values which allow the charging electric power generated by the intentional swing of user's arm to be detected. The central control circuit 93 includes a non-generation time measuring circuit 99 for measuring a non-generation time Tn during which generation of electric power is not detected by either the first detection circuit 97 or the second detection circuit 98. If the continuous non-generation time Tn becomes greater than a predetermined value, the operating mode is switched from the normal indication mode to the power saving mode.

On the other hand, switching from the power saving mode to the normal indication mode is performed when the electric power generation state detector 91 detects that electric power is being generated by the electric power generating part A and when the charge voltage VC of the large-capacitance capacitor 48 is high enough.

In this specific embodiment, because the power supply part B has the step-up/down circuit 49, it is possible to drive the hand driving mechanism D using the step-up/down circuit 49 when the charge voltage VC is low as long as the charge voltage VC is within an allowable range. The central control circuit 93 determines the step-up ratio depending on the charge voltage VC and controls the step-up/down circuit 49 in accordance with the step-up ratio determined.

However, if the charge voltage VC is too low, it is impossible to obtained a power supply voltage high enough to drive the hand driving mechanism E even if the voltage is stepped up. If the operating mode is switched from the power saving mode to the normal indication mode when the charge voltage VC is at such a low level, time cannot be indicated correctly and electric power is uselessly consumed. In the present embodiment, to avoid the above problem, the charge voltage VC is compared with a predetermined set voltage Vc to determine whether the charge voltage VC is high enough. This is employed as one condition which should be met to switch the operating mode from the power saving mode to the normal indication mode.

The current mode set in the above described manner is stored in the mode memory 94. Information stored in the mode memory 94 is supplied to the driving control circuit 24, the time information memory 96, and the set value selector 95. If the operating mode is switched from the normal indication mode to the power saving mode, the driving control circuit 24 stops supplying the pulse signal to the driver E thereby stopping the operation of the driver E and thus stopping the rotation of the second hand driving motor 10*a* and the hour/minute hand driving motor 10*b*. Thus, the operation of indicating time is stopped.

The time information memory 96 includes a counter and a memory (not shown). When the operating mode is switched from the normal indication mode to the power saving mode, the time information memory 96 starts to measure the time in response to the reference signal generated by the pulse synthesizer 22. The time information memory 96 stops measuring the time when the operating mode is switched from the power saving mode to the normal indication mode. Thus, the time elapsed in the power saving mode is measured. The measured value of the time elapsed in the power saving mode is stored in the memory. Furthermore, when the operating mode is switched from the power saving mode to the normal indication mode, the counter of the time information memory 96 counts quick driving pulses supplied from the driving control circuit 24 to the driver D. If the count value reaches a value corresponding to the time elapsed in the power saving mode, the time information memory 96 outputs a control signal to the driver D thereby stopping the supply of the quick driving pulses. Thus, the time information memory 96 also serves to adjust the indication of time to the current time. The contents of the counter and the memory are cleared when the operating mode is switched from the normal indication mode to the power saving mode.

The driving control circuit 24 generates driving pulses depending on the operating mode, on the basis of various pulses output from the pulse synthesizer 22. In the power saving mode, the driving control circuit 24 stops the supply of driving pulses. Immediately after the switching from the power saving mode to the normal indication mode, the driving control circuit 24 supplies quick driving pulses at short intervals as the driving pulses to the driver E thereby adjusting the indication of time to the current time. After completion of supplying the quick driving pulses, the driving control circuit 24 supplies driving pulses at normal intervals to the driver E.

Figure 4:
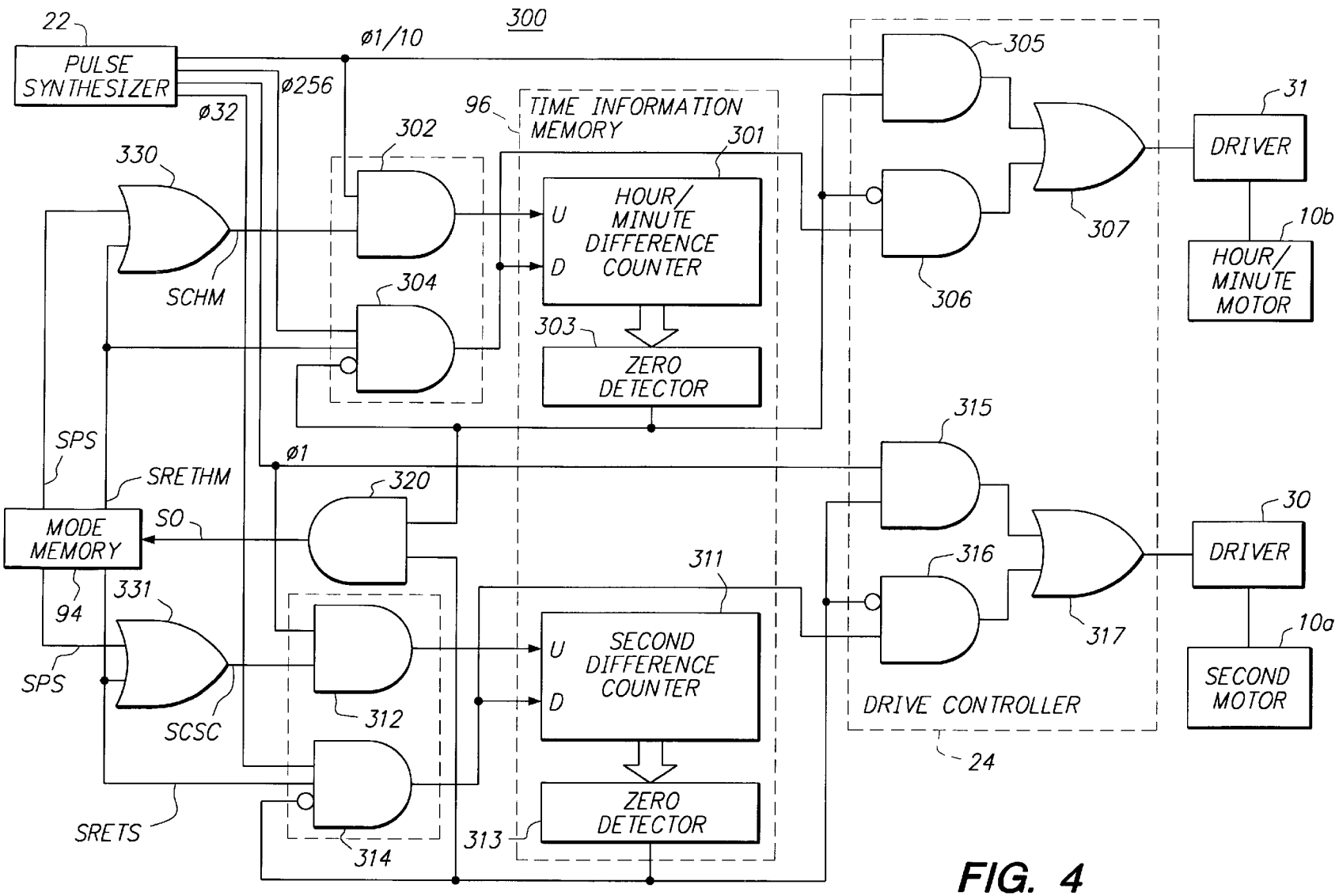
FIG. 4 is a block diagram illustrating the construction of a time adjusting part.

Referring to FIG. 4, the construction of the time adjusting part for achieving the time adjusting capability is described below.

The time adjusting part 300 includes the pulse synthesizer 22 for generating a pulse signal $\phi$1 (one pulse per sec), a pulse signal $\phi$1/10 (one pulse every 10 sec), a pulse signal $\phi$32 (32 pulses per sec), and a pulse signal $\phi$256 (256 pulses per sec).

Of these pulses, the pulse signal $\phi$1 is used to drive the second hand in the normal operating mode, and the pulse signal $\phi 1/10$ is used to drive the hour and minute hands in the normal operating mode.

The pulse signal $\phi 32$ is used as the quick driving pulse to drive the second hand in the time adjusting operation, and the pulse signal $\phi 256$ is used as the quick driving pulse to drive the hour and minute hands in the time adjusting operation.

The time adjusting part 300 is formed of the time information memory 96, the driving control circuit 24, the driver 31, the driver 30, a hour/minute hand driving motor 10*b*, and a second hand driving motor 10*a*.

The time adjusting pulse 300 also includes an AND gate 302 one input of which the pulse signal $\phi 1/10$ is applied to, the other input of which a hour/minute counting signal $S_{CHM}$ output from an OR gate 330 which will be described later is applied to, and which outputs a signal in response to which an up/down counter serving as a hour/minute difference counter (for counting the difference between the actual current time and the time indicated by the hour and minute hands at rest) 301 in the time information memory counts up; a zero detector 303 for detecting whether or not the count value of the hour/minute difference counter 301 is equal to zero, that is, whether or not the time indicated by the hour and minute hands is coincident with the actual current time; an AND gate 304 a first input terminal of which the inverted output of the zero detector 303 is applied to, a second input terminal of which the hour/minute adjusting control signal $S_{RETHM}$ is applied to, a third input terminal of which the pulse signal $\phi 256$ is applied to, and which outputs a signal in response to which the hour/minute difference counter 301 counts down during the time adjusting operation; an AND gate 305 one input terminal of which the pulse signal $\phi 1/10$ is applied to and the other input terminal of which the output of the zero detector 303 is applied to; an AND gate 306 one input terminal of which the output signal of the AND gate 304 is applied to and the other input terminal of which the inverted output of the zero detector 303 is applied to; and an OR gate 307 which exclusively outputs either the pulse signal $\phi 1/10$ output from the AND gate 305 (in the normal operating mode) or the pulse signal $\phi 256$ output from the AND gate 306 (in the time adjusting operation).

The time adjusting part 300 further includes an AND gate 312 one input terminal of which the pulse signal $\phi 1$ is applied to, the other input terminal of which the second counting signal $S_{csc}$ output from an OR gate 331 is applied to, and which output a signal in response to which an up/down counter serving as a second difference counter (for counting the difference between the actual current time and the time indicated by the second hand at rest) 311 in the time information memory counts up; a zero detector 313 for detecting whether or not the count value of the second difference counter 311 is equal to zero, that is, whether or not the time indicated by the second hand is coincident with the actual current time; an AND gate 314 a first input terminal of which the inverted output of the zero detector 313 is applied to, a second input terminal of which the second adjusting control signal $S_{RETS}$ is applied to, a third input terminal of which the pulse signal $\phi 32$ is applied to, and which outputs a signal in response to which the second difference counter 311 counts down during the time adjusting operation; an AND gate 315 one input terminal of which the pulse signal $\phi 1/$ is applied to and the other input terminal of which the output of the zero detector 313 is applied to; an AND gate 316 one input terminal of which the output signal of the AND gate 314 is applied to and the other input terminal of which the inverted output of the zero detector 313 is applied to; and an OR gate 317 which exclusively outputs either the pulse signal $\phi 1/$ output from the AND gate 315 (in the normal operating mode) or the pulse signal $\phi 32$ output from the AND gate 316 (in the time adjusting operation).

The time adjusting part 300 further includes an AND gate 320 to which the outputs of the zero detector 303 and the zero detector 313 are input and which outputs a zero detection signal S0; an OR gate 330 one input terminal of which the hour/minute adjusting control signal $S_{RETHM}$ is applied to, the other input terminal of which a power saving mode control signal $S_{PS}$ is applied to, and which outputs a hour/minute counting signal $S_{CHM}$ as a result of the logical OR operation between the two control signals; and an OR gate 331 one input terminal of which the second adjusting control signal $S_{RETS}$ is applied to, the other input terminal of which the power saving mode control signal $S_{PS}$ is applied to, and which outputs a second counting signal $S_{CSC}$ as a result of the logical OR operation between the two control signals.

The general operation is described below.

In the following description, for simplicity of illustration, only one time adjusting control signal $S_{RET}$ is used to represent both the hour/minute adjusting control signal $S_{REHM}$ and the second adjusting control signal $S_{RETS}$. However, note that, in practice, the hour/minute adjusting control signal $S_{REHM}$ and the second adjusting control signal $S_{RETS}$ vary with different timing, and thus the adjusting operation is performed with different timing.

The logical OR between the power saving mode control signal $P_{PS}$ and the hour/minute adjusting control signal $S_{RETHM}$ is calculated by the OR gate 330, and the result is output to the AND gate 302. Furthermore, the logical OR between the power saving mode control signal $P_{PS}$ and the second adjusting control signal $S_{RETS}$ is calculated by the OR gate 331, and the result is output to the AND gate 312. As a result, the time elapsed during the operation of adjusting the indication of time is also counted up by the hour/minute difference counter 301 or the second difference counter 311 thereby ensuring that the time elapsed during the operation of adjusting the indication of time is reflected in the adjusting of time.

When the power saving mode control signal $S_{PS}$ and the time adjusting control signal $S_{RET}$ (=hour/minute adjusting control signal $S_{RETHM}$+second adjusting control signal $S_{RETS}$) output from the mode memory 94 are both at the low level, the output signals of the AND gate 302, the AND gate 304, the AND gate 312, and the AND gate 314 are all at the low level.

The pulse signal $\phi 1/10$ is supplied to the driver 31 via the AND gate 305 and the OR gate 307. In response to the pulse signal $\phi 1/10$, the driver 31 drives the hour/minute hand driving motor 10*b* so as to drive the hour and minute hands once every 10 sec. On the other hand, the pulse signal $\phi 1$ is supplied to the driver 30 via the AND gate 315 and the OR gate 317. In response to the pulse signal $\phi 1$, the driver 30 drives the second hand driving motor 10*a* so as to drive the second hand once every sec.

When the power saving mode control signal $S_{PS}$ output from the mode memory 94 is at the high level, the AND gate 302 outputs the pulse signal $\phi 1/10$. In response to the pulse signal $\phi 1/10$, the hour/minute difference counter 301 counts up. That is, the hour/minute difference counter 301 counts the difference between the actual current time and the time indicated by the hour and minute hands at rest.

In this state, the output of the zero detector 303 is at the low level. Therefore, the time adjusting control signal $S_{RET}$ (=hour/minute adjusting control signal $S_{RETHM}$+second adjusting control signal $S_{RETS}$) is also at the low level. As a result, the outputs of the AND gate 304, the AND gate 305, and the AND gate 306 are all at the low level, and thus no signal is supplied to the driver 31 and the hour and minute hands are at rest.

Similarly, the AND gate 312 outputs the pulse signal ϕ1, in response to which the second difference counter 311 counts up. That is, the second difference counter 311 counts the difference between the actual current time and the time indicated by the second hand at rest.

In this state, the output of the zero detector 313 is at the low level, and the time adjusting control signal $S_{RET}$ is also at the low level. Therefore, the outputs of the AND gate 314, the AND gate 315, and the AND gate 316 are all at the low level, and thus no signal is supplied to the driver 30, and the second hand is at rest.

At the time when a high-level time adjusting control signal $S_{RET}$ is output, the output of the zero detector 303 is at the low level, and thus the inverted output of the zero detector 303 becomes high. Therefore, the AND gate 304 outputs the pulse signal ϕ256, in response to which the hour/minute difference counter 302 counts down. The pulse signal ϕ256 output from the AND gate 304 is also supplied to the AND gate 306.

During the operation of adjusting the indication of time, the hour/minute difference counter 302 counts up in response to the down-counted pulse signal ϕ1/10 so that the time elapsed during the operation of adjusting the indication of time is reflected in the adjusting of the indication of time.

Thus the AND gate 306 outputs the pulse signal ϕ256 to the driver 31, which in turn drives the hour/minute hand driving motor **10*b*** so as to drive the hour and minute hands once every 1/256 sec.

When the output of the zero detector 303 becomes high, the time indicated by the hour and minute hands becomes coincident with the actual current time, and the pulse signal ϕ1/10 is again supplied to the driver 31 via the AND gate 305 and the OR gate 307. In response to the pulse signal ϕ1/10, the driver 31 drives the hour/minute hand driving motor **10*b*** so as to drive the hour and minute hands once every 10 sec.

On the other hand, the output of the AND gate 312 becomes low. At the time when a high-level time adjusting control signal $S_{RET}$ is output, the output of the zero detector 313 is at the low level, and thus the inverted output thereof becomes high. Therefore, the AND gate 314 outputs the pulse signal ϕ32, in response to which the hour/minute difference counter 302 counts down. The pulse signal ϕ32 output from the AND gate 314 is also supplied to the AND gate 316.

Thus the AND gate 316 outputs the pulse signal ϕ32 to the driver 30, which in turn drives the second hand driving motor **10*a*** so as to drive the second hand once every 1/32 sec.

When the output of the zero detector 303 becomes high, the time indicated by the second hand becomes coincident with the actual current time, and the pulse signal ϕ1 is again supplied to the driver 30 via the AND gate 315 and the OR gate 317. In response to the pulse signal ϕ1, the driver 30 drives the second hand driving motor **10*a*** so as to drive the second hand once every sec.

[2] General Operation of Respective Embodiments

Figure 5:
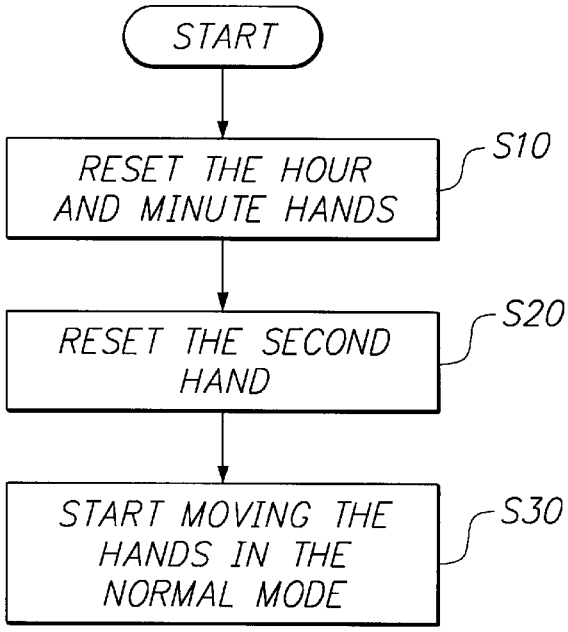
FIG. 5 is a flow chart illustrating the general operation of each embodiment according to the present invention.

Referring now to FIG. 5, the generation operation is described for each embodiment of the present invention.

The operation of each embodiment of the present invention is concerned with the operation of adjusting the indication of time when the operating mode of the wristwatch is switched from the power saving mode to the normal indication mode. The operation of adjusting the indication of time is performed at a speed higher than the normal hand driving speed in the normal time indication mode and in a short time which does not result in a significant deviation between the actual current time and the time indicated by the hands after the adjusting operation. The operation of adjusting the indication of time is generally performed in accordance with the following steps. The operation of adjusting the indication of time starts when the power saving mode is terminated. First, the hour hand and the minute hand are adjusted such that they indicate the actual current time by quickly driving them in accordance with the time elapsed in the power saving mode (S10). The second hand is then quickly driven in accordance with the time elapsed in the power saving mode such that the second hand indicates the actual current time (S20). When the hands have been adjusted so as to indicate the actual current time, the operation mode is switched to the normal mode (S30). After that, the respective hands are moved at the normal speeds so as to correctly indicate the current time.

[3] First Embodiment

In a first embodiment, the hour/minute hand driving motor and the second hand driving motor are driven independently of each other. To achieve a reduction in the power consumption, the hour hand and the minute hand are first adjusted using the hour/minute hand driving motor rotating at a speed higher than the second hand driving motor, and then the second hand is adjusted using the second hand driving motor.

There is provided a driving direction determination unit 200 for determining, under the control of the controller, in which direction hands should be driven to adjust the indication of time. That is, the driving direction determination unit 200 determines whether the hands should be driven in a clockwise (forward) direction or in a counterclockwise (reverse) direction to perform the adjusting of indication of time with less power consumption.

The driving direction determination unit 200 includes a counter state detector formed of a counter and a logic gate to determine in which direction the hands should be driven to adjust the hands to positions corresponding to the current time, in accordance with the state of the counter.

[3.1] Operation of the First Embodiment

The operation of the first embodiment is described below for the case where the operating mode is switched from the power saving mode to the normal time indication mode, the respective hands are quickly moved to correct positions corresponding to the actual current time, and then the hands are driven in the normal mode to indicate the current time.

Figure 6:
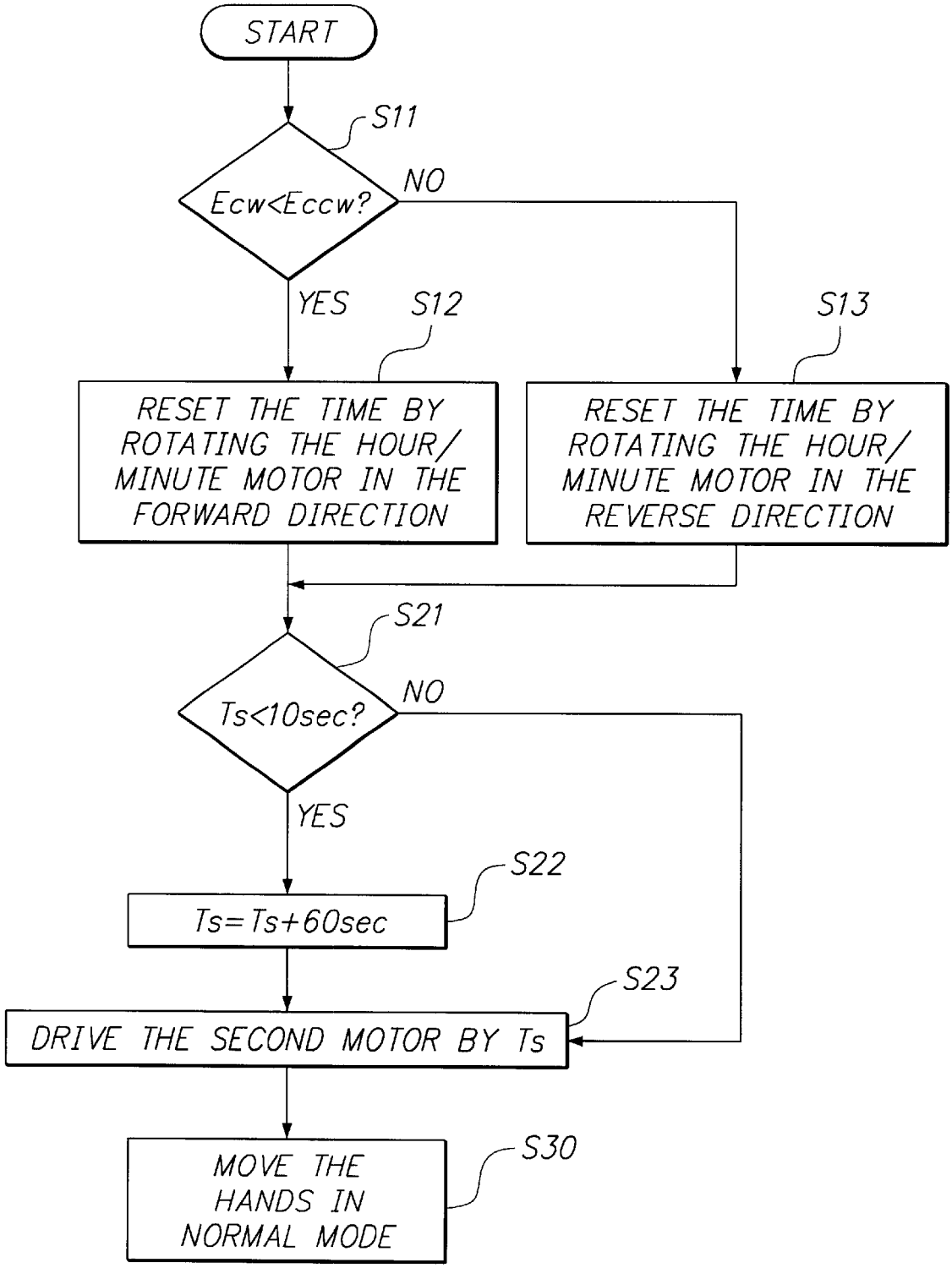
FIG. 6 is a flow chart illustrating the operation of the first embodiment according to the invention.

FIG. 6 is a flow chart illustrating the operation of the first embodiment.

By way of example, it is assumed here that indication of time was stopped at 22 hr 08 min 42 sec and the time information memory 96 starts at 22 hr 08 min 42 sec to measure the time elapsed in the power saving mode (however, the time indicated by the hands at rest is 10 hr 08 min 42 sec) and that indication of time is restarted at 08 hr 18 min 43 sec on the next day.

The power saving mode is terminated if the voltage detection circuit 92 detects that a sufficiently high voltage is generated and if the charge voltage VC of the power supply part B is high enough.

In step S11, if the power saving mode is terminated, the driving direction determination unit 200 calculates, on the basis of the time elapsed in the power saving mode counted by and stored in the time information memory 96, the energy Ecw which will be required to quickly move the hands in a clockwise (forward) direction to the positions corresponding to the actual current time and the energy Eccw which will be required to quickly move the hands in a counterclockwise (reverse) direction to the positions corresponding to the actual current time, and determines whether Ecw<Eccw. More specifically, on the basis of the time elapsed in the power saving mode (10 hr 10 min 01 sec in this specific example) counted by and stored in the time information memory 96, the driving direction determination unit 200 calculates the energy Ecw which will be required to quickly rotate the hour/minute hand driving motor in the clockwise (forward) direction by an amount which would have been rotated in the normal mode for 10 hr 10 min 01 sec and the energy Eccw which will be required to quickly rotate the hour/minute hand driving motor in the counterclockwise (reverse) direction by an amount corresponding to 01 hr 49 min 59 sec, and determines whether Ecw<Eccw.

In general, the energy consumption required to move the hands in the forward direction is different from that required to move the hands in the reverse direction. Therefore, it cannot be determined whether Ecw<Eccw simply from the amounts of movement of the hands. In practice, the driving direction determination unit 200 makes the decision by comparing amounts of the energy consumption corresponding to the time elapsed in the power saving mode as shown in FIG. 6.

In this specific example, it is assumed that driving the hand in the reverse direction needs energy 3 times greater than required to drive the hands by the same amount in the forward direction.

If a positive decision is made by the driving direction determination unit 200 in step 11, that is, if $$Ecw<Eccw$$

then the process goes to step 12 in which the hour/minute hand driving motor is rotated in the clockwise (forward) direction so as to adjust the indication of time to the actual current time. After that, the process goes to step 21.

On the other hand, if a negative decision is made by the driving direction determination unit 200 in step 11, that is, if $$Ecw \geq Eccw$$

then the process goes to step 13 in which the hour/minute hand driving motor is rotated in the counterclockwise (reverse) direction so as to adjust the indication of time to the actual current time. After that, the process goes to step 21.

Figure 7:
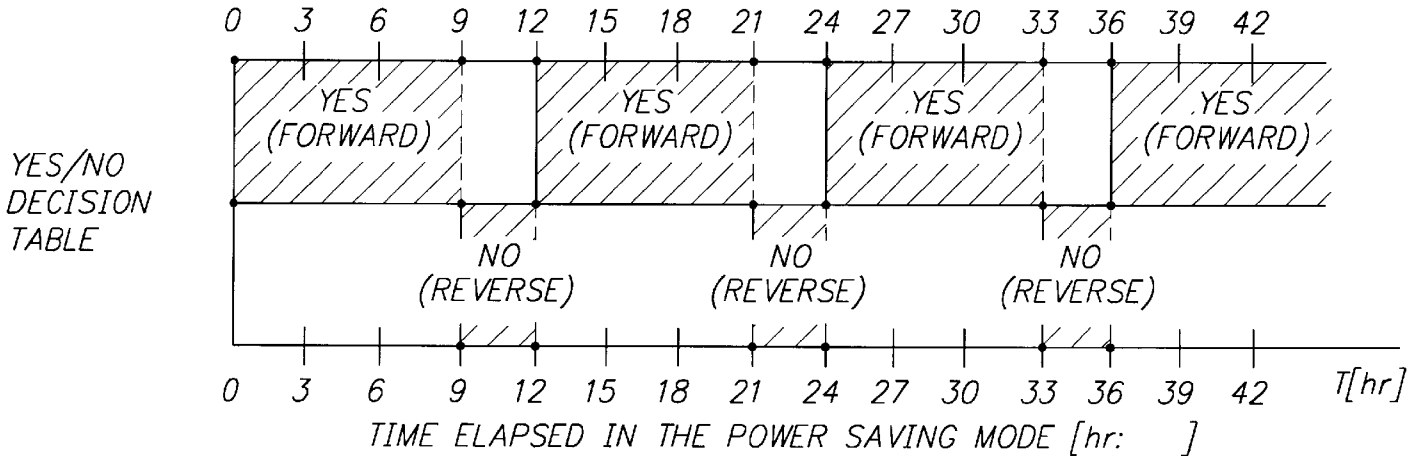
FIG. 7 is an example of a hand driving direction decision table stored in a driving direction determination unit 200 according to the first embodiment of the invention.

In this specific example, a negative decision is made by referring to a Yes/No decision table such as that shown in FIG. 7 for the case of the time elapsed in the power saving mode (10 hr 10 min 01 sec). Thus, the process goes to step S13, and the hour/minute hand driving motor is rotated in the reverse direction for the adjusting of the indication of time.

In the next step 21, it is determined whether the time difference Ts between the actual current time and the time indicated by the second hand at rest is less than a lower limit Tr which allows a user to visually recognize the motion of the second hand in the time adjusting operation, that is, it is determined whether $$Ts<Tr.$$

Herein, the threshold value Tr is set in advance to, for example, 10 sec.

If a negative decision is made in step 21, that is, if the time difference Ts is equal to or greater than the threshold value Tr, the process goes to step S23 which will be described later.

If a positive decision is made in step 21, that is, if the time difference Ts is smaller than the threshold value Tr, then the process goes to step 22 and Ts is set such that Ts=Ts+60 sec.

In step 23, the second hand driving motor 10*a* is driven by an amount corresponding to Ts in the forward direction.

After completion of the above-described process, the operating mode of the wristwatch switches to the normal mode, and driving of the hands at the normal speeds is started.

Thus, the user can get accurate current time from the indication.

[3.1.1] Modification of the First Embodiment

In the first embodiment described above, when the time difference Ts is less than the threshold value Tr, Ts is set such that Ts=Ts+60 sec. More generally, when the angle R [°] required to rotate for the time adjusting operation is less than a predetermined value RT [°], the time adjusting rotation angle $R_{RET}$ may be determined as follows:

$$R_{RET}=R+360\times n[°] \text{(where n is a natural number).}$$

[3.2] Second Embodiment

In the first embodiment described above, time adjusting is performed in accordance with the result of comparison between the energy Ecw required to quickly move the hands in the clockwise (forward) direction to the positions corresponding to the actual current time and the energy Eccw required to move the hands in the counterclockwise (reverse) direction, calculated from the time elapsed in the power saving mode. In this second embodiment, in contrast, the time required to quickly move the hands in the clockwise (forward) direction to the positions corresponding to the actual current time and the time required to move the hands in the counterclockwise (reverse) direction are compared with each other, and time adjusting is performed in accordance with the comparison result.

In the embodiment, step S11 shown in FIG. 6 in the hour and minute hand adjusting process according to the first embodiment described above is replaced with step S11' as shown in FIG. 8. In the case where step S11 is replaced with step S11', the driving direction determination unit 200 calculates the adjusting time (Tcw) required to adjust the hands to the positions corresponding to the actual current time by quickly moving the hands in the clockwise (forward) direction (that is, the time required to quickly drive the hour/minute hand driving motor 10*b* by an amount corresponding to the rotation which would have occurred for 10 hr 10 min 01 sec) and the adjusting time (Tccw) required to adjust the hand positions by moving the hands in the counterclockwise (reverse) direction (that is, the time required to quickly drive the hour/minute hand driving motor 10*b* by an amount corresponding to 01 hr 49 min 59 sec), and determines whether Tcw<Tccw.

If a positive decision is made by the driving direction determination unit 200 in step 11', that is, if $$Tcw<Tccw$$

then the process goes to step 12 in which the hour/minute hand driving motor 10*b* is rotated in the clockwise (forward) direction so as to adjust the indication of time to the actual current time. After that, the process goes to step 21.

On the other hand, if a negative decision is made by the driving direction determination unit 200 in step 11', that is, if Tcw≧Tccw then the process goes to step 13 in which the hour/minute hand driving motor 10*b* is rotated in the counterclockwise (reverse) direction so as to adjust the indication of time to the actual current time. After that, the process goes to step 21.

Figure 9:
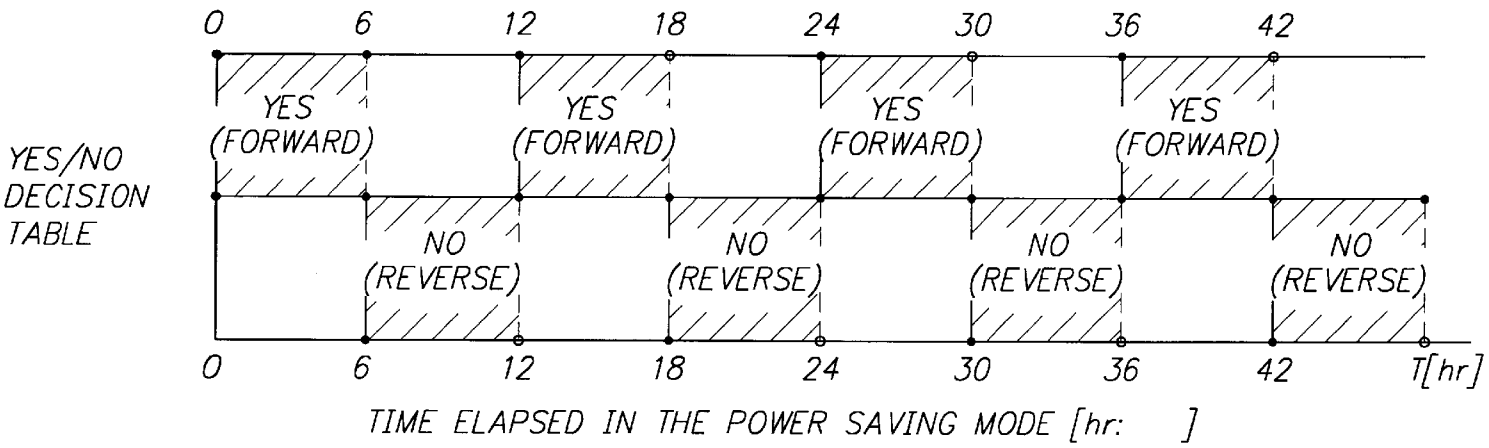
FIG. 9 is an example of a hand driving direction decision table stored in a driving direction determination unit 200 according to the second embodiment of the invention.

In practice, the driving direction determination unit 200 makes the decision by comparing the adjusting times corresponding to the time elapsed in the power saving mode as shown in FIG. 9 (in a comparative example of the present embodiment, it is assumed that the time required to move the hand in the clockwise (forward) direction is equal to that required to move the hands in the counterclockwise (reverse) direction).

In the specific example described above, a negative decision is made (in step S11) by referring to the Yes/No decision table shown in FIG. 9 as to the time elapsed in the power saving mode (10 hr 10 min 01 sec) and thus the process goes to step 13 and time adjusting is performed by moving the hands in the reverse direction. After that, the process goes to step 21. Subsequently, the position of the second hand is adjusted in the same manner as in the first embodiment.

[3.3] Third Embodiment

Figure 10:
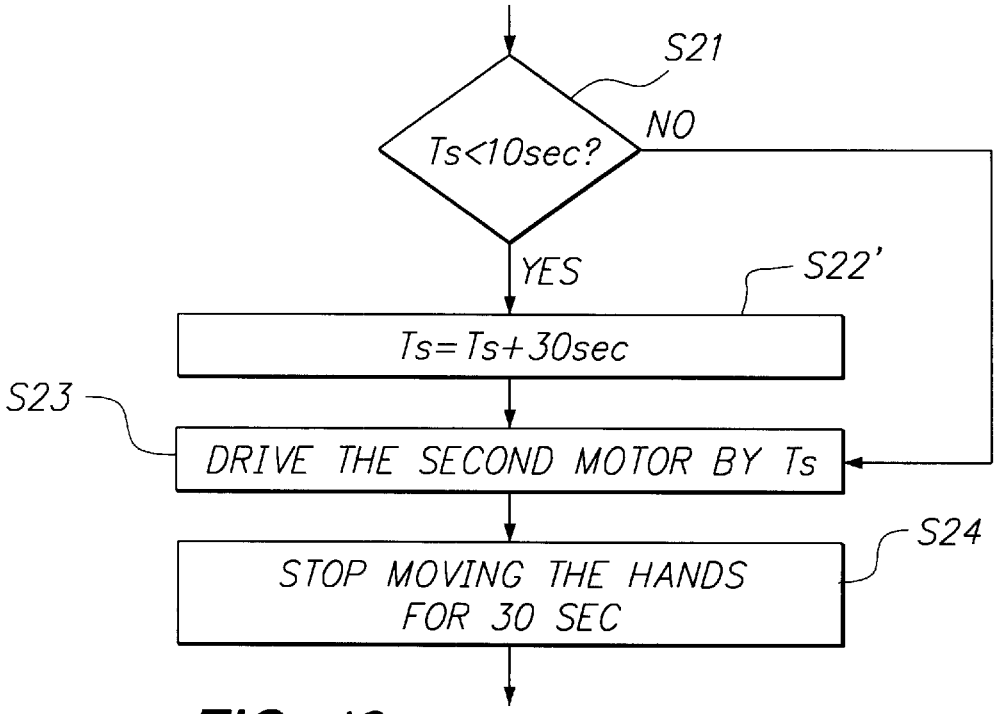
FIG. 10 is a flow chart illustrating the operation of a third embodiment according to the invention.

In this third embodiment, steps S22–S23 shown in FIG. 6 in which the position of the second hand is adjusted according to the first embodiment are replaced with steps S22'–S24 as shown in FIG. 10.

The process from the start to step S21 is the same as that in the first embodiment, and thus step S21 and the following steps are described below.

In step 21, it is determined whether the time difference Ts between the actual current time and the time indicated by the second hand at rest is less than the threshold value Tr. If a negative decision is made in step 21, that is, if the time difference Ts is equal to or greater than the threshold value Tr, the process goes to step S23 which will be described later. If a positive decision is made in step 21, that is, if the time difference Ts is smaller than the threshold value Tr, then the process goes to step 22' and Ts is set such that Ts=Ts+30 sec. In step 23, the second hand driving motor 10*a* is driven by an mount corresponding to Ts in the forward direction. At this stage of the process, the second hands indicates a time advanced by 30 sec with respect to the actual current time. Then the process goes to step 24, and the second hands is stopped for 30 sec before the operating mode is switched to the normal mode. After 30 sec has elapsed, driving of the second hand at the normal speed is started.

Thus, the user can get accurate current time from the indication.

Figure 8:
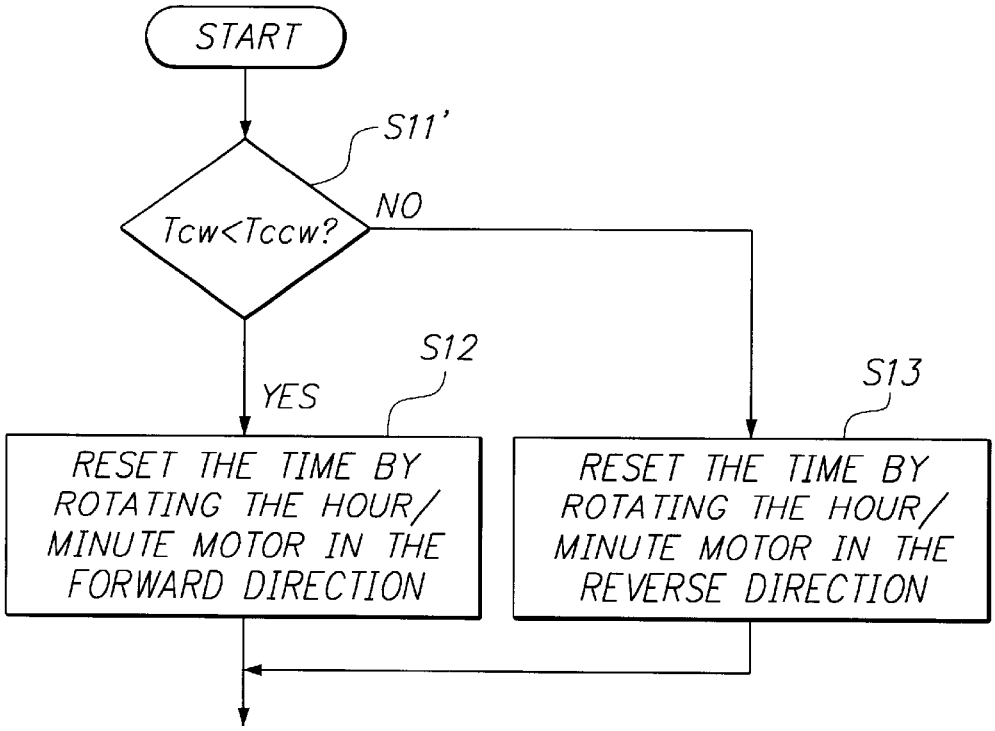
FIG. 8 is a flow chart illustrating the operation of a second embodiment according to the invention.

Step 11 in the hour and minute hand adjusting process of the present embodiment may be replaced with step 11' of the second embodiment shown in FIG. 8.

[3.4] Fourth Embodiment

Figure 11:
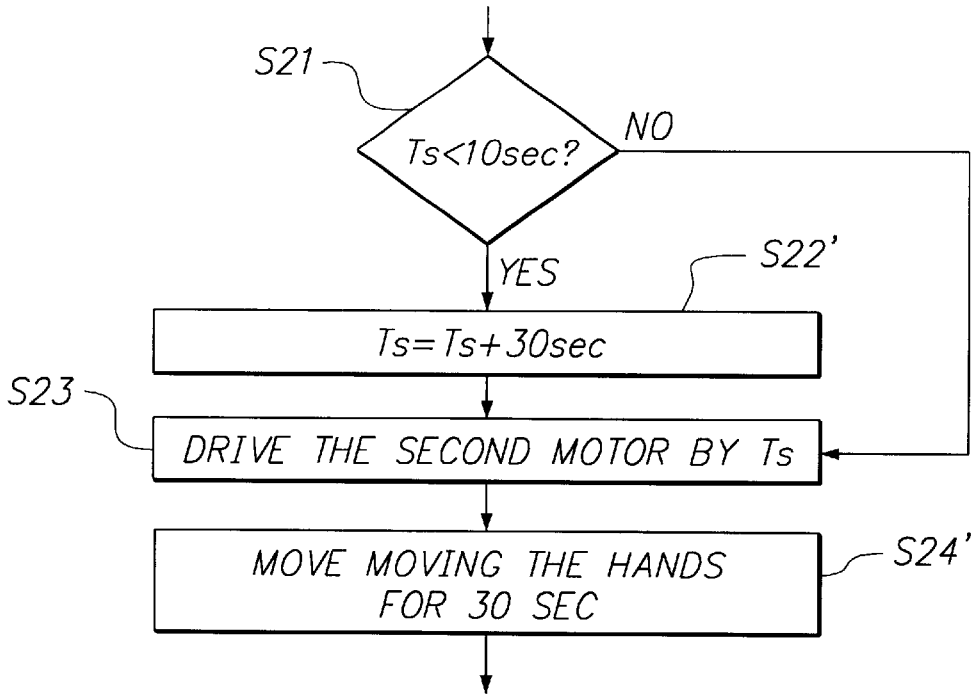
FIG. 11 is a flow chart illustrating the operation of a fourth embodiment according to the invention.

In this fourth embodiment, steps S22–S23 of the first embodiment shown in FIG. 6 are replaced with steps S22'–S24' as shown in FIG. 11.

The process from the start to step S21 is the same as that in the first embodiment, and thus step S21 and the following steps are described below.

In step 21, it is determined whether the time difference Ts between the actual current time and the time indicated by the second hand at rest is less than the threshold value Tr. If a negative decision is made in step 21, that is, if the time difference Ts is equal to or greater than the threshold value Tr, the process goes to step S23' which will be described later. If a positive decision is made in step 21, that is, if the time difference Ts is smaller than the threshold value Tr, then the process goes to step 22' and Ts is set such that Ts=Ts+30 sec. In step 23', the second hand driving motor is driven by an amount corresponding to Ts in the forward direction. At this stage of the process, the second hands indicates a time advanced by 30 sec with respect to the actual current time. Then the process goes to step 24', and the second hands is moved in the reverse direction by an amount corresponding to 30 sec, that is, 180°.

After completion of the above-described process, driving of the second hand at the normal speed is started so as to indicate the actual current time. Thus, the user can get accurate current time from the indication.

[3.4.1] Modification of the Fourth Embodiment

Step 11 in the hour and minute hand adjusting process of the present embodiment may be replaced with step 11' of the second embodiment shown in FIG. 8.

Specific examples of the electric power generating mechanism of the electric power generating part include an electromagnetic induction electric power generator, a solar cell, a thermal electric power generator, a piezoelectric device, and floating electromagnetic wave transmission (electromagnetic induction electric power generator using a broadcast/communication radio wave). The number of electric power generating mechanisms is not limited to one. Two or more different electric power generating mechanisms may be employed at the same time.

In the present embodiment described above, when the time difference Ts is less than the threshold value Tr, Ts is set such that Ts=Ts+30 sec, and then the second hand is moved in the reverse direction by an amount corresponding to 30 sec. More generally, when the hand angle R [°] corresponding to the movement of the hand which would have occur for a time corresponding to the time difference is less than a predetermined value RT [°], and when an additional rotation angle is assumed to be $\alpha$ [°], the time adjusting rotation angle $R_{RET}$ may be given as $R_{RET}=R+\alpha$ [°]. After moving the hand in a first direction by the amount determined above, the hand may be moved by the additional rotation angle $\alpha$ in a second direction opposite to the first direction.

[3.5] Fifth Embodiment

Figure 12:
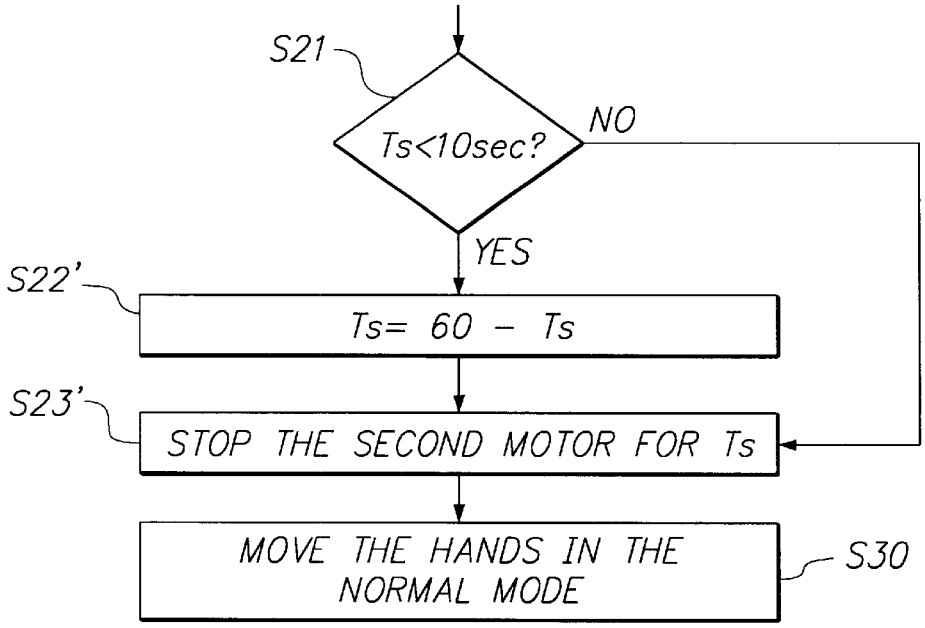
FIG. 12 is a flow chart illustrating the operation of a fifth embodiment according to the invention.

In this fifth embodiment, steps S22–S23 of the first embodiment shown in FIG. 6 are replaced with steps S22"–S23" as shown in FIG. 12.

The process from the start to step S21 is the same as that in the first embodiment, and thus step S21 and the following steps are described below.

In step 21, it is determined whether the time difference Ts between the actual current time and the time indicated by the second hand at rest is less than the threshold value Tr. If a negative decision is made in step 21, that is, if the time difference Ts is equal to or greater than the threshold value Tr, the process goes to step S23" which will be described later. If a positive decision is made in step 21, that is, if the time difference Ts is smaller than the threshold value Tr, then the process goes to step 22" and Ts is set such that Ts=Tr−Ts sec.

In step 23", the second hand driving motor is stopped for Ts until the time indicated by the second hand becomes coincident with the actual current time.

After completion of the above-described process, driving of the second hand at the normal speed is started in the normal mode. Thus, the user can get accurate current time from the indication.

[3.6] Sixth Embodiment

In the time adjusting operation in the embodiments described above, either hour/minute hand driving pulses or second hand driving pulses are first output, and then, after completion of outputting the pulses, the other pulses are output. In this sixth embodiment, hour/minute hand driving pulses and second hand driving pulses are alternately output such that there is no overlapping in the output timing.

Figure 13:
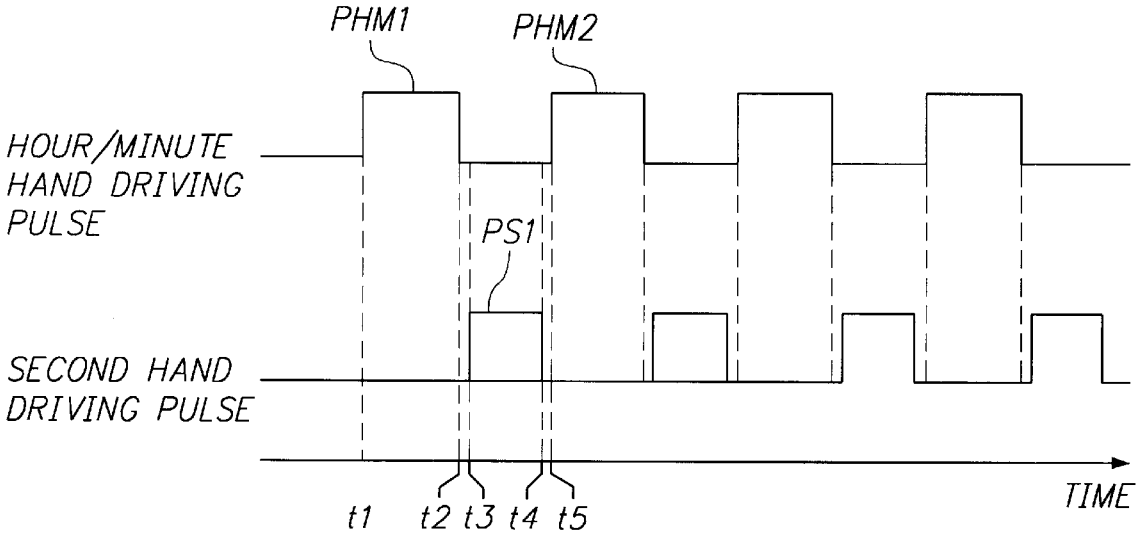
FIG. 13 is a timing diagram illustrating the operation of a sixth embodiment according to the invention.

FIG. 13 is a timing chart illustrating the operation of outputting driving pulses according to the sixth embodiment.

In this sixth embodiment, as shown in FIG. 13, a hour/minute hand driving pulse $P_{HM1}$ is first output during a period from t1 to t2.

At time t3 after completion of the output of the hour/minute hand driving pulse $P_{HM1}$, outputting of a second hand driving pulse $P_{S1}$ is started. The outputting of the second hand driving pulse $P_{S1}$ is completed before time t4.

Then at time t5 after completion of the output of the second hand driving pulse $P_{S1}$, outputting of a next hour/minute hand driving pulse $P_{HM2}$ is started.

After that, hour/minute hand driving pulses and second hand driving pulses are alternately output in a similar manner such that there is no overlapping in the output timing. This allows the hour/minute hands and the second hand to be adjusted apparently at the same time to positions corresponding to the actual current time without causing a significant increase in the load imposed upon the power supply. Thus, the time adjusting can be performed while maintaining the power supply in a stable state.

[4] Modifications

[4.1] First Modification

In the embodiments described above, the hand driving direction in the time adjusting operation is selected each time adjusting is performed. Alternatively, a hand may be driven in a predetermined direction in the time adjusting operation.

In this case, from the viewpoint of reduction in the power consumption, it is desirable to stop the second hand until the time indicated by the second hand becomes coincident with the actual current time rather than moving it in a predetermined direction.

This makes it unnecessary to determine the driving direction associated with the second hand and thus makes it possible to construct the circuit in a simpler fashion than in the embodiments described above.

[4.2] Second Modification

In the embodiments described above, both the second hand and the hour/minute hands are stopped in the power saving mode. Alternatively, the power saving mode may include sub-modes, that is, a first power saving mode (in which only the second hand is stopped and the hour and minute hands are continued to be driven) and a second power saving mode (in which both the second hand and the hour/minute hands are stopped).

[4.3] Third Modification

In the embodiments described above, it is assumed that time adjusting is performed for a time-measurement device having hour/minute hands and a second hand. Adjusting may also be performed for a time-measurement device having the calendar capability. In this case, the calendar driving part may be controlled in the adjusting operation in a similar manner as for the hour/minute driving part or the second hand driving part.

In this case, it is required that the calendar driving part can be driven independently, that is, the calendar driving part includes a calendar driving motor.

[4.4] Fourth Modification

In the embodiments described above, the driving timing is determined in an exclusive manner for the hour/minute hands and the second hand, respectively, such that the hour/minute hands and the second hand are not driven at the same time. Alternatively, there may be a partial overlap in the driving timing as long as the load is maintained within an allowable range.

More specifically, the period of time during which the load becomes too large can be minimized by setting the overlapping period of the driving timing within a predetermined range.

[4.5] Fifth Modification

Although in the embodiments described above, the hour/minute hands and the second hands are driven, the hour hand, the minute hand, and the second hand may be driven separately in a similar manner as in the above-described embodiments without causing an increase in the load at a particular time.

[4.6] Sixth Modification

In the embodiments described above, the operating mode is switched between the power saving mode and the normal indication mode in accordance with the electric power generation state of the electric power generator or the charging status of the capacitor serving as the electric power storage device. Alternatively, an electronic wristwatch may include a carrying state detection sensor for detecting whether the electronic wristwatch is being carried whereby the normal indication mode is employed when the electronic wristwatch is being carried and the power saving mode is employed when the electronic wristwatch is not carried.

In this case, the carrying state detection sensor may be realized by an acceleration sensor for detecting the motion of a user, a contact sensor for detecting whether the wristwatch is worn by the user, or other types of sensors.

[4.7] Seventh Modification

In the time-measurement device according to any of the embodiments described above, the power supply device includes the electric power generator and the capacitor (electric power storage device). However, the invention is not limited to such a type of time-measurement device. The invention may also be applied to various time-measurement devices such as a time-measurement device including a primary battery, a time-measurement device including a secondary battery, and a cock device including both an electric power generator and a secondary battery.

[5] Aspects of the Invention

Various aspect of the present invention are described below.

[5.1] First Aspect

A first aspect of the invention provides a method of controlling a time-measurement device comprising: a power supply device for supplying electric power; time indication device including a plurality of indication hand driving parts for driving corresponding indication hands using electric power supplied by the power supply device so as to indicate time by the plurality of indication hands; a controller for switching the operating mode for each of the indication hand driving parts in accordance with a predetermined condition, between a power saving mode in which the corresponding indication hand is not driven and an indication mode in which the corresponding indication hand is continuously driven; and an elapsed-time memory for storing the time elapsed in the power saving mode; the method comprising a time adjusting step for adjusting indication of time by driving the indication hands using the indication hand driving part in accordance with the time elapsed in the power saving mode when the operating mode is changed from the power saving mode to the normal indication mode, wherein the time adjusting step includes a time adjusting operation control step for controlling the plurality of indication hand driving parts in the operation of adjusting the indication of time such that the plurality of indication hand driving parts are driven in a predetermined order and such that an overlap among adjusting operation periods of the plurality of indication hand driving parts is less than a predetermined value. In this first aspect, the time adjusting operation control step may set the adjusting operation period for the plurality of indication hand driving parts in an exclusive fashion (first modification of the first aspect).

In the time adjusting step according to the first aspect described above, of the plurality of indication hand driving parts, an indication hand driving part whose driving speed in a normal driving operation is lower than that of the other indication hand driving parts may be driven to adjust the position of the associated hand preceding the other indication hand driving parts and then an indication hand driving part having a higher normal driving speed may be driven to adjust the position of the associated hand (second modification of the first aspect).

Furthermore, in the time adjusting step according to the first aspect described above, of the plurality of indication hand driving parts, an indication hand driving part whose driving speed in a normal driving operation is higher than that of the other indication hand driving parts may be driven to adjust the position of the associated hand preceding the other indication hand driving parts and then an indication hand driving part having a lower normal driving speed may be driven to adjust the position of the associated hand (third modification of the first aspect).

Furthermore, the condition is the state in which electric power is generated by the electric power generation means or the state in which electric energy is stored in the power supply means. (fourth modification of the first aspect).

Still furthermore, the time-measurement device may further comprise carrying state detection means for detecting whether or not the time-measurement device is being carried, and the condition may be the state in which the time-measurement device is being carried (fifth modification of the first aspect).

[5.2] Second Aspect

A second aspect of the invention provides a method of controlling a time-measurement device comprising a power supply device for supplying electric power; a time indicating device including an indication hand driving device for driving an indication hand using electric power supplied by the power supply device so as to indicate time by the indication hand; a controller for switching the operating mode in accordance with a predetermined condition, between a power saving mode in which the corresponding indication hand is not driven and an indication mode in which the corresponding indication hand is continuously driven; and an elapsed-time memory for storing the time elapsed in the power saving mode; the method comprising a time adjusting step for adjusting indication of time by driving the indication hand using the indication hand driving device in accordance with the time elapsed in the power saving mode when the operating mode is switched from the power saving mode to the indication mode, wherein the time adjusting step includes an adjusting direction determination step for determining the direction in which the indication hand is driven to adjust the indication of time, in accordance with the time elapsed in the power saving mode. In the adjusting direction determination step according to the second aspect described above, a direction in which the indication hand can be driven with less electric power than would be required to drive the indication hand in the opposite direction may be employed as the adjusting direction (first modification of the second aspect).

In the adjusting direction determination step according to the second aspect described above, a direction in which the indication hand can be driven in a shorter time than would be required to drive the indication hand in the opposite direction may be employed as the adjusting direction (second modification of the second aspect).

In the time adjusting step according to the second aspect described above, when the angle R [°] required to rotate to adjust the indication of time is less than a predetermined value RT [°], the time adjusting rotation angle $R_{RET}$ may be determined in accordance with the following equation:

$$R_{RET}=R+360\times n\ [°]$$ (where n is a natural number) (third modification of the second aspect).

In the time adjusting step according to the second aspect described above, the time adjusting operation may be performed such that the second hand is maintained at the position where the second hand has been at rest during the power saving mode until the time indicated by the second hand at rest becomes coincident with the actual current time, and driving of the second hand is started when the time indicated by the second hand at rest has become coincident with the actual current time (fourth modification of the second aspect).

In the time adjusting step according to the second aspect described above, when the angle R [°] required to rotate to adjust the indication of time is less than a predetermined value RT [°], and when an additional rotation angle is set to α, the time adjusting means determines the time adjusting rotation angle $R_{RET}$ in accordance with the following equation:

$$R_{RET}=R+\alpha[°]$$ (fifth modification of the second aspect).

In the adjusting direction determination step according to the second aspect described above, when the angle between the hand position corresponding to the current time and the actual hand position is greater than a predetermined value, the indication hand may be driven to adjust the hand position in a direction opposite to the normal hand driving direction (sixth modification of the second aspect).

Furthermore, in the second aspect described above, the indication hand driving device may include a plurality of sub-indication hand driving devices for driving different indication hands, and, in the adjusting direction determination step, the adjusting direction may be determined for each of the plurality of subindication hand driving devices (seventh modification of the second aspect).

Furthermore, in the second aspect described above, the indication hand driving device may include a hour/minute hand driving device for driving a hour hand and a minute hand, and a second hand driving device for driving a second hand, in the adjusting direction determination step, the hand position adjusting direction may be determined for each of the hour/minute hand driving device and the second hand driving device (eighth modification of the second aspect). In the time adjusting step according to the eighth modification of the second aspect, when the indication of time is adjusted, the hour/minute hand driving device may be driven preceding the second hand driving device, and the second hand driving device may be driven after completion of the driving of the hour and minute hands (ninth modification of the second aspect).

Furthermore, in the second aspect described above, the indication hand driving device may include a hour/minute hand driving device for driving a hour hand and a minute hand, a second hand driving device for driving a second hand, and a second hand driving device for driving a second hand, and in the adjusting direction determination step, the hand position adjusting direction may be determined for each of the hour hand driving device, the minute hand driving device, and the second hand driving device (tenth modification of the second aspect). Furthermore, in the eighth modification of the second aspect, when the indication of time is adjusted, the hour hand driving device, the minute hand driving device, and the second hand driving device may be driven in an exclusive fashion in the following order:

hour hand driving device→minute hand driving device→second hand driving device.

Furthermore, the condition may be the state in which electric power is generated by the electric power generation means or the state in which electric energy is stored in the power supply means (eleventh modification of the second aspect).

Furthermore, the time-measurement device may further comprise carrying state detection means for detecting whether or not the time-measurement device is being carried, and the condition may be the state in which the time-measurement device is being carried (twelfth modification of the second aspect).

Advantages

When indication of time is adjusted, the timing of driving a plurality of indication hand driving parts is controlled such that the plurality of indication hand driving parts are driven in a predetermined order and such that the overlapping period of the adjusting operation period associated with the plurality of indication hand driving parts becomes less than a predetermined value. This allows a transient increase in the load during the time adjusting operation to be minimized, and thus the electric power required to perform the time adjusting operation is minimized.

Furthermore, when indication of time is adjusted, each hand is driven separately in a direction determined for each hand, thereby allowing the positions of the respective hands to be adjusted in a shorter time.

More specifically, when indication of time is adjusted, the hour and minute hands are adjusted first by driving the hour/minute motor, and then the position of the second hand is adjusted so as to indicate the current time by driving the second motor. This allows the time adjusting operation to be performed under the stable condition in terms of the power supply voltage without encountering a failure in the operation due to the instability of the power supply voltage. Furthermore, the power consumption required to adjust the indication of time by driving the hands in the clockwise direction and the power consumption required to adjust the indication of time by driving the hands in the counterclockwise direction are compared with each other, and the hands are driven in a direction which results in less power consumption. The hands may also be driven in a direction which results in a shortest adjusting time thereby reducing the power consumption and the adjusting time.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

Reference Numerals

1 . . . Time-measurement Device
A . . . Electric Power Generation Part
B . . . Electric Power Supply Part
C . . . Controller
D . . . Driver
E . . . Hand Driving Mechanism
10*a*: Second Hand Driving Motor
24: Driving Control Circuit
10*b*: Hand/Minute Hand Driving Motor
30, 31: Driver
93: Central Control Circuit
95: Set Value Selector
96: Time Information Memory
200: Driving Direction Determination Unit

What is claimed is:

1. A time-measurement device comprising:

power supply means for supplying electric power;

time indicating means including a plurality of indication hand driving parts for driving a corresponding plurality of indication hands using electric power supplied by said power supply means so as to indicate time by said plurality of indication hands;

control means for switching an operating mode for each of said plurality of indication hand driving parts in accordance with a predetermined condition between a power saving mode in which said plurality of indication hands are not driven and a normal indication mode in which said plurality of indication hands are continuously driven;

elapsed-time storage means for storing an elapsed time when the operating mode is in the power saving mode; and time adjusting means for adjusting an indication of time by driving said plurality of indication hand driving parts in accordance with the time elapsed stored in said elapsed-time storage means after the operating mode is changed from the power saving mode to the normal indication mode;

wherein said time adjusting means includes time adjusting operation control means for controlling a timing of driving said plurality of indication hand driving parts such that at least one of said plurality of indication hand driving parts is driven during a first time period and at least another one of said plurality of indication hand driving parts is driven during a second time period, and said first time period is exclusive of said second time period for at least a portion of a time adjustment period.

2. A time-measurement device according to claim 1, wherein said time adjusting operation control means controls the timing of driving said plurality of indication hand driving parts such that a first one of said plurality of indication hand driving parts is driven at different times than a second one of said plurality of indication hand driving parts.

3. A time-measurement device according to claim 1, wherein said time adjusting means adjusts the indication of time such that a first one of said plurality of indication hand driving parts having a lower normal driving speed is driven for adjustment before a second one of said plurality indication hand driving parts having a higher normal driving speed is driven for adjustment.

4. A time-measurement device according to claim 1, wherein said time adjusting means adjusts the indication of time such that a first one of said plurality of indication hand driving parts having a higher normal driving speed is driven for adjustment before a second one of said plurality indication hand driving parts having a lower normal driving speed is driven for adjustment.

5. A time-measurement device according to claim 1, wherein a first one of said plurality of indication hand driving parts comprises an hour/minute hand driving means, wherein a second one of said plurality of indication hand driving parts comprises a second hand driving means, wherein said time adjusting means adjusts the indication of time such that said hour/minute hand driving means is driven preceding said second hand driving means, and wherein said second hand driving means is driven after completion of driving of said hour/minute hand driving means.

6. A time-measurement device according to claim 1, wherein when said time adjusting means adjusts the indication of time, said time adjusting means drives said plurality of hand driving parts by outputting corresponding driving pulses to each of said plurality of indication hand driving parts such that the corresponding driving pulses are output at different times.

7. A time-measurement device according to claim 1, wherein a first one of said plurality of indication hand driving parts comprises an hour hand driving means, wherein a second one of said plurality of indication hand driving parts comprises a minute hand driving means, wherein a third one of said plurality of indication hand driving parts comprises a second hand driving means, wherein when said time adjusting means adjusts the indication of time, said time adjusting means drives said hour hand driving means before driving said minute hand driving means and drives said minute hand driving means before driving said second hand driving means.

8. A time-measurement device comprising:

power supply means for supplying electric power;

time indicating means including indication hand driving means for driving an indication hand using electric power supplied by said power supply means so as to indicate time by said indication hand;

control means for switching the operating mode in accordance with a predetermined condition, between a power saving mode in which said indication hand is not driven and a normal indication mode in which said indication hand is continuously driven;

elapsed-time storage means for storing the time elapsed in the power saving mode; and time adjusting means for adjusting an indication of time by driving said indication hands using said indication hand driving means in accordance with the time elapsed in the power saving mode when the operating mode is switched from the power saving mode to the normal indication mode;

wherein said time adjusting means includes time adjusting direction determination means for determining the direction in which said indication hand is driven to adjust the indication of time, in accordance with the time elapsed in the power saving mode.

9. A time-measurement device according to claim 7, wherein said time adjusting direction determination means selects a direction, as a time adjusting direction, in which said indication hand is driven with less electric power than would be required to drive said indication hand in an opposite direction.

10. A time-measurement device according to claim 7, wherein said time adjusting direction determination means selects a direction, as a time adjusting direction, in which said indication hand is driven in a shorter time than would be required to drive said indication hand in an opposite direction.

11. A time-measurement device according to claim 7, wherein when an angle R [°] required to rotate to adjust the indication of time is less than a predetermined value RT [°], said time adjusting means determines a time adjusting rotation angle $R_{RET}$ in accordance with the following equation:

$$R_{RET}=R+360\times n[°] \text{(where n is a natural number).}$$

12. A time-measurement device according to claim 7, wherein when the indication of time is adjusted, said time adjusting means maintain indication hand at a position where said indication hand has been at rest during the power saving mode until the time indicated by said indication hand at rest becomes coincident with an actual current time and starts to drive said indication hand when the time indicated by said indication hand at rest has become coincident with an actual current time.

13. A time-measurement device according to claim 7, wherein when an angle R [°] required to rotate to adjust the indication of time is less than a predetermined value RT [°] and when an additional rotation angle is set to α, said time adjusting means determines a time adjusting rotation angle $R_{RET}$ in accordance with the following equation:

$$R_{RET}=R+\alpha[°],$$

and drives said indication hand in a first direction by the time adjusting rotation angle $R_{RET}$, and then drives said indication hand by a rotation angle α in a second direction opposite to the first direction.

14. A time-measurement device according to claim 8, wherein when an angle between a hand position corresponding to a current time and an actual hand position is greater than a predetermined value, said time adjusting direction determination means selects the direction in which said indication hand is driven to adjust the hand position such that said indication hand is driven in a direction opposite to the direction in which said indication hand is driven in the normal mode.

15. A time-measurement device according to claim 8, further comprising:

a plurality of indication hands; and a corresponding plurality of indication hand driving means for driving said plurality of indication hands, wherein said time adjusting direction determination means determines the adjusting direction for each of said plurality of indication hands.

16. A time-measurement device according to claim 15, wherein said time adjusting means adjusts the indication of time such that, of said plurality of indication hands, an indication hand driving part having a lower normal driving speed is driven for adjustment before an indication hand driving part having a higher normal driving speed is driven for adjustment.

17. A time-measurement device according to claim 8, wherein:

said plurality of indication hands comprises an hour hand, a minute hand and a second hand, said plurality of indication hand driving means includes:

hour/minute hand driving means for driving said hour hand and said minute hand, and second hand driving means for driving said second hand, and said time adjusting direction determination means determines the direction in which a hand is driven to adjust the indication of time for each of said hour/minute hand driving means and said second hand driving means.

18. A time-measurement device according to claim 8, further comprising an hour hand, a minute hand and a second hand, wherein said indication hand driving means includes hour hand driving means for driving said hour hand, minute hand driving means for driving said minute hand, and second hand driving means for driving said second hand; and said time adjusting direction determination means determines the direction in which a hand is driven to adjust the indication of time for each of said hour hand driving means, said minute hand driving means, and said second hand driving means.

19. A time-measurement device according to claim 1 or 8, wherein said power supply means includes electric power storage means for storing electric energy.

20. A time-measurement device according to claim 1 or 8, wherein said power supply means includes:

electric power generation means for generating electric power by converting first energy into electric energy; and electric power storage means for storing the generated electric energy.

21. A time-measurement device according to claim 20, wherein said first energy is energy selected from the group consisting of kinetic energy, light energy, thermal energy, pressure energy, and electromagnetic wave energy.

22. A time-measurement device according to claim 1 or 8, wherein said power supply means comprises a primary battery.

23. A time-measurement device according to claim 1 or 8, wherein the predetermined condition is a state in which electric power is generated by said electric power generation means or a state in which electric energy is stored in said power supply means.

24. A time-measurement device according to claim 1 or 8, further comprising carrying state detection means for detecting whether said time-measurement device is being carried, and said condition is a state in which said time-measurement device is being carried.

25. A method of controlling a time-measurement device comprising: a power supply device for supplying electric power; a time indication device including a plurality of indication hand driving parts for driving corresponding indication hands using electric power supplied by the power supply device so as to indicate time by the plurality of indication hands; a controller for switching the operating mode for each of the indication hand driving parts in accordance with a predetermined condition, between a power saving mode in which an indication hand is not driven and a normal indication mode in which an indication hand is continuously driven; and an elapsed-time memory for storing the time elapsed in the power saving mode, said method comprising the steps of adjusting the indication of time by driving the indication hands using the indication hand driving parts in accordance with the time elapsed in the power saving mode when the operating mode is switched from the power saving mode to the normal indication mode; and controlling the plurality of indication hand driving parts in the operation of adjusting the indication of time such that the plurality of indication hand driving parts are driven such that at least one of said plurality of indication hand driving parts is driven during a first time period and at least another one of said plurality of indication hand driving parts is driven during a second time period, and said first time period is exclusive of said second time period for at least a portion of a time adjustment period.

26. A method of controlling a time-measurement device comprising: a power supply device for supplying electric power; a time indication device including an indication hand driving device for driving an indication hand using electric power supplied by the power supply device so as to indicate time by the indication hand; a controller for switching the operating mode in accordance with a predetermined condition, between a power saving mode in which corresponding the indication hand is not driven and a normal indication mode in which corresponding the indication hand is continuously driven; and an elapsed-time memory for storing the time elapsed in the power saving mode, said method comprising the steps of:

adjusting the indication of time by driving the indication hand using the indication hand driving device in accordance with the time elapsed in the power saving mode when the operating mode is switched from the power saving mode to the normal indication mode; and determining the direction in which the indication hand is driven to adjust the indication of time, in accordance with the time elapsed in the power saving mode.

27. A time-measurement device comprising:

a power supply to supply electric power;

a time indication device including a plurality of indication hand driving parts for driving a corresponding plurality of indication hands using electric power supplied by said power supply so as to indicate time by said plurality of indication hands;

a controller to switch an operating mode for each of said plurality of indication hand driving parts in accordance with a predetermined condition between a power saving mode in which said plurality of indication hands are not driven and a normal indication mode in which said plurality of indication hands are continuously driven;

an elapsed-time memory to store an elapsed time when the operating mode is in the power saving mode; and a time adjusting circuit to adjust an indication of time by driving said plurality of indication hand driving parts in accordance with the time elapsed stored in said elapsed-time memory after the operating mode is changed from the power saving mode to the normal indication mode;

wherein said time adjusting circuit includes a time adjusting operation controller to control a timing of driving said plurality of indication hand driving parts such that at least one of said plurality of indication hand driving parts is driven during a first time period and at least another one of said plurality of indication hand driving parts is driven during a second time period, and said first time period is exclusive of said second time period for at least a portion of a time adjustment period.

28. A time-measurement device according to claim 27, wherein said time adjusting operation controller controls the timing of driving said plurality of indication hand driving parts such that a first one of said plurality of indication hand driving parts is driven at different times than a second one of said plurality of indication hand driving parts.

29. A time-measurement device according to claim 27, wherein said time adjusting circuit adjusts the indication of time such that a first one of said plurality of indication hand driving parts having a lower normal driving speed is driven for adjustment before a second one of said plurality indication hand driving parts having a higher normal driving speed is driven for adjustment.

30. A time-measurement device according to claim 27, wherein said time adjusting circuit adjusts the indication of time such that a first one of said plurality of indication hand driving parts having a higher normal driving speed is driven for adjustment before a second one of said plurality indication hand driving parts having a lower normal driving speed is driven for adjustment.

31. A time-measurement device according to claim 27, wherein a first one of said plurality of indication hand driving parts comprises an hour/minute hand driver, wherein a second one of said plurality of indication hand driving parts comprises a second hand driver, wherein said time adjusting circuit adjusts the indication of time such that said hour/minute hand driver is driven preceding said second hand driver, and wherein said second hand driver is driven after completion of driving of said hour/minute hand driver.

32. A time-measurement device according to claim 27, wherein when said time adjusting circuit adjusts the indication of time, said time adjusting circuit drives said plurality of hand driving parts by outputting corresponding driving pulses to each of said plurality of indication hand driving parts such that the corresponding driving pulses are output at different times.

33. A time-measurement device according to claim 27, wherein a first one of said plurality of indication hand driving parts comprises an hour hand driver, wherein a second one of said plurality of indication hand driving parts comprises a minute hand driver, wherein a third one of said plurality of indication hand driving parts comprises a second hand driver, wherein when said time adjusting circuit adjusts the indication of time, said time adjusting circuit drives said hour hand driver before driving said minute hand driver and drives said minute hand driver before driving said second hand driver.

34. A time-measurement device comprising:

a power supply to supply electric power;

a time indication device including an indication hand driver for driving an indication hand using electric power supplied by said power supply so as to indicate time by said indication hand;

a controller to switch the operating mode in accordance with a predetermined condition, between a power saving mode in which said indication hand is not driven and a normal indication mode in which said indication hand is continuously driven;

an elapsed-time memory to store the time elapsed in the power saving mode; and a time adjusting circuit to adjust an indication of time by driving said indication hand using said indication hand driver in accordance with the time elapsed in the power saving mode when the operating mode is switched from the power saving mode to the normal indication mode;

wherein said time adjusting circuit includes time adjusting direction determination circuit to determine the direction in which said indication hand is driven to adjust the indication of time, in accordance with the time elapsed in the power saving mode.

35. A time-measurement device according to claim 34, wherein said time adjusting direction determination circuit selects a direction, as a time adjusting direction, in which said indication hand is driven with less electric power than would be required to drive said indication hand in an opposite direction.

36. A time-measurement device according to claim 34, wherein said time adjusting direction determination circuit selects a direction, as a time adjusting direction, in which said indication hand is driven in a shorter time than would be required to drive said indication hand in an opposite direction.

37. A time-measurement device according to claim 34, wherein when an angle R [°] required to rotate to adjust the indication of time is less than a predetermined value RT [°], said time adjusting circuit determines a time adjusting rotation angle $R_{RET}$ in accordance with the following equation:

$$R_{RET}=R+360\times n[°] \text{(where n is a natural number).}$$

38. A time-measurement device according to claim 34, wherein when the indication of time is adjusted, said time adjusting circuit maintains said indication hand at a position where said indication hand has been at rest during the power saving mode until the time indicated by said indication hand at rest becomes coincident with an actual current time and starts to drive said indication hand when the time indicated by said indication hand at rest has become coincident with an actual current time.

39. A time-measurement device according to claim 34, wherein when an angle R [°] required to rotate to adjust the indication of time is less than a predetermined value RT [°] and when an additional rotation angle is set to α, said time adjusting circuit determines a time adjusting rotation angle $R_{RET}$ in accordance with the following equation:

$$R_{RET}=R+\alpha[°],$$

and drives said indication hand in a first direction by the time adjusting rotation angle $R_{RET}$, and then drives said indication hand by a rotation angle α in a second direction opposite to the first direction.

40. A time-measurement device according to claim 34, wherein when an angle between a hand position corresponding to a current time and an actual hand position is greater than a predetermined value, said time adjusting direction determination circuit selects the direction in which said indication hand is driven to adjust the hand position such that said indication hand is driven in a direction opposite to the direction in which said indication hand is driven in the normal mode.

41. A time-measurement device according to claim 34, further comprising:

a plurality of indication hands; and a corresponding plurality of indication hand drivers for driving said plurality of indication hands, wherein said time adjusting direction determination circuit determines the adjusting direction for each of said plurality of indication hands.

42. A time-measurement device according to claim 41, wherein said time adjusting circuit adjusts the indication of time such that, of said plurality of indication hands, an indication hand driving part having a lower normal driving speed is driven for adjustment before an indication hand driving part having a higher normal driving speed is driven for adjustment.

43. A time-measurement device according to claim 34, wherein:

said plurality of indication hands comprise an hour hand, a minute hand and a second hand, said plurality of indication hand drivers include:

an hour/minute hand driver for driving said hour hand and said minute hand, and a second hand driver for driving said second hand, and said time adjusting direction determination circuit determines the direction in which a hand is driven to adjust the indication of time for each of said hour/minute hand driver and said second hand driver.

44. A time-measurement device according to claim 34, further comprising an hour hand, a minute hand and a second hand, wherein said indication hand driver includes an hour hand driver for driving said hour hand, a minute hand driver for driving said minute hand, and a second hand driver for driving said second hand; and said time adjusting direction determination circuit determines the direction in which a hand is driven to adjust the indication of time for each of said hour hand driver, said minute hand driver, and said second hand driver.

45. A time-measurement device according to claim 27 or 34, wherein said power supply includes electric power memory to store electric energy.

46. A time-measurement device according to claim 27 or 34, wherein said power supply includes:

electric power generator to generate electric power by converting first energy into electric energy; and electric power memory to store the generated electric energy.

47. A time-measurement device according to claim 46, wherein said first energy is energy selected from the group consisting of kinetic energy, light energy, thermal energy, pressure energy, and electromagnetic wave energy.

48. A time-measurement device according to claim 27 or 34, wherein said power supply comprises a primary battery.

49. A time-measurement device according to claim 27 or 34, wherein the predetermined condition is a state in which electric power is generated by said electric power generator or a state in which electric energy is stored in said power supply.

50. A time-measurement device according to claim 27 or 34, further comprising carrying state detector to detect whether said time-measurement device is being carried, and said condition is a state in which said time-measurement device is being carried.

* * * * *

UNITED STATES PATENT AND TRADEMARK OFFICE

CERTIFICATE OF CORRECTION

PATENT NO. : 6,367,967 B1
DATED : April 9, 2002
INVENTOR(S) : Hiroyuki Kojima et al.

It is certified that error appears in the above-identified patent and that said Letters Patent is hereby corrected as shown below:

Column 29,
Line 24, insert -- indication -- after "of".
Line 66, correct "7" to -- 8 --.

Column 30,
Line 5, correct "7" to -- 8 --.
Line 11, correct "7" to -- 8 --.
Line 18, correct "7" to -- 8 --.
Line 27, correct "7" to -- 8 --.

Column 33,
Line 32, insert -- indication -- after "of".

Signed and Sealed this

Fifth Day of November, 2002

*Attest:*

*Attesting Officer*

JAMES E. ROGAN
*Director of the United States Patent and Trademark Office*